US009034244B2

(12) United States Patent
Cooper

(10) Patent No.: US 9,034,244 B2
(45) **Date of Patent: *May 19, 2015**

(54) GAS-TRANSFER FOOT

(71) Applicant: Paul V. Cooper, Chesterland, OH (US)

(72) Inventor: Paul V. Cooper, Chesterland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/752,312

(22) Filed: Jan. 28, 2013

(65) Prior Publication Data

US 2013/0142625 A1 Jun. 6, 2013

Related U.S. Application Data

(63) Continuation of application No. 12/395,430, filed on Feb. 27, 2009, now Pat. No. 8,361,379, which is a continuation of application No. 11/413,982, filed on Apr. 28, 2006, now abandoned, and a continuation of (Continued)

(51) Int. Cl.

| | |
|---|---|
| ***F01D 1/36*** | (2006.01) |
| ***F04D 7/00*** | (2006.01) |
| ***F04D 7/06*** | (2006.01) |
| ***F04D 29/70*** | (2006.01) |
| ***F04D 31/00*** | (2006.01) |

(52) U.S. Cl.
CPC *F04D 7/00* (2013.01); *F04D 7/065* (2013.01); *F04D 29/708* (2013.01); *F04D 31/00* (2013.01)

(58) Field of Classification Search
CPC ..... F04D 7/05; F04D 7/065
USPC ..... 266/217, 239; 417/435, 502
See application file for complete search history.

(56) References Cited

U.S. PATENT DOCUMENTS

| | | | |
|---|---|---|---|
| 35,604 | A | 6/1862 | Guild |
| 116,797 | A | 7/1871 | Barnhart |

(Continued)

FOREIGN PATENT DOCUMENTS

| | | |
|---|---|---|
| CA | 683469 | 3/1964 |
| CA | 2115929 | 8/1992 |

(Continued)

OTHER PUBLICATIONS

US 5961265, Oct. 5, 1999, Meneice et al. (withdrawn).

(Continued)

*Primary Examiner* — Scott Kastler
(74) *Attorney, Agent, or Firm* — Snell & Wilmer LLP

(57) ABSTRACT

The present invention includes a molten metal pump and associated components that enable gas to be released into a stream of molten metal. The gas may be released into the molten metal stream (preferably into the bottom of the stream) flowing through a passage. Such a stream may be within the pump discharge and/or within a metal-transfer conduit extending from the pump discharge. The gas is released by using a gas-transfer foot that is positioned next to and is preferably attachable to the pump base or to the metal-transfer conduit. Preferably, the conduit (and/or discharge) in which the gas is released comprises two sections: a first section having a first cross-sectional area and a second section downstream of the first section and having a second cross-sectional area, wherein the second cross sectional area is larger than the first cross-sectional area. Preferably, the gas is released into or near the second section so that the gas is released into an area of relatively lower pressure.

17 Claims, 22 Drawing Sheets

Related U.S. Application Data application No. 12/120,190, filed on May 13, 2008, now Pat. No. 8,178,037, which is a continuation of application No. 10/773,101, filed on Feb. 4, 2004, now abandoned, which is a continuation of application No. 10/619,405, filed on Jul. 14, 2003, now Pat. No. 7,507,367, and a continuation of application No. 10/620,318, filed on Jul. 14, 2003, now Pat. No. 7,731,891.

(60) Provisional application No. 60/395,471, filed on Jul. 12, 2002.

(56) References Cited

U.S. PATENT DOCUMENTS

| | | | |
|---|---|---|---|
| 209,219 | A | 10/1878 | Bookwalter |
| 251,104 | A | 12/1881 | Finch |
| 364,804 | A | 6/1887 | Cole |
| 390,319 | A | 10/1888 | Thomson |
| 495,760 | A | 4/1893 | Seitz |
| 506,572 | A | 10/1893 | Wagener |
| 585,188 | A | 6/1897 | Davis |
| 757,932 | A | 4/1904 | Jones |
| 882,477 | A | 3/1908 | Neumann |
| 882,478 | A | 3/1908 | Neumann |
| 890,319 | A | 6/1908 | Wells |
| 898,499 | A | 9/1908 | O'Donnell |
| 909,774 | A | 1/1909 | Flora |
| 919,194 | A | 4/1909 | Livingston |
| 1,037,659 | A | 9/1912 | Rembert |
| 1,100,475 | A | 6/1914 | Franckaerts |
| 1,196,758 | A | 9/1916 | Blair |
| 1,304,068 | A | 5/1919 | Krogh |
| 1,331,997 | A | 2/1920 | Neal |
| 1,377,101 | A | 5/1921 | Sparling |
| 1,380,798 | A | 6/1921 | Hansen et al. |
| 1,439,365 | A | 12/1922 | Hazell |
| 1,454,967 | A | 5/1923 | Gill |
| 1,470,607 | A | 10/1923 | Hazell |
| 1,513,875 | A | 11/1924 | Wilke |
| 1,518,501 | A | 12/1924 | Gill |
| 1,522,765 | A | 1/1925 | Wilke |
| 1,526,851 | A | 2/1925 | Hall |
| 1,669,668 | A | 5/1928 | Marshall |
| 1,673,594 | A | 6/1928 | Schmidt |
| 1,697,202 | A | 1/1929 | Nagle |
| 1,717,969 | A | 6/1929 | Goodner |
| 1,718,396 | A | 6/1929 | Wheeler |
| 1,896,201 | A | 2/1933 | Sterner-Rainer |
| 1,988,875 | A | 1/1935 | Saborio |
| 2,013,455 | A | 9/1935 | Baxter |
| 2,038,221 | A | 4/1936 | Kagi |
| 2,075,633 | A | 3/1937 | Anderegg |
| 2,090,162 | A | 8/1937 | Tighe |
| 2,091,677 | A | 8/1937 | Fredericks |
| 2,138,814 | A | 12/1938 | Bressler |
| 2,173,377 | A | 9/1939 | Schultz, Jr. et al. |
| 2,264,740 | A | 12/1941 | Brown |
| 2,280,979 | A | 4/1942 | Rocke |
| 2,290,961 | A | 7/1942 | Heuer |
| 2,300,688 | A | 11/1942 | Nagle |
| 2,304,849 | A | 12/1942 | Ruthman |
| 2,368,962 | A | 2/1945 | Blom |
| 2,383,424 | A | 8/1945 | Stepanoff |
| 2,423,655 | A | 7/1947 | Mars et al. |
| 2,488,447 | A | 11/1949 | Tangen et al. |
| 2,493,467 | A | 1/1950 | Sunnen |
| 2,515,097 | A | 7/1950 | Schryber |
| 2,515,478 | A | 7/1950 | Tooley et al. |
| 2,528,208 | A | 10/1950 | Bonsack et al. |
| 2,528,210 | A | 10/1950 | Stewart |
| 2,543,633 | A | 2/1951 | Lamphere |
| 2,566,892 | A | 9/1951 | Jacobs |
| 2,625,720 | A | 1/1953 | Ross |
| 2,626,086 | A | 1/1953 | Forrest |
| 2,676,279 | A | 4/1954 | Wilson |
| 2,677,609 | A | 5/1954 | Moore et al. |
| 2,698,583 | A | 1/1955 | House et al. |
| 2,714,354 | A | 8/1955 | Farrand |
| 2,762,095 | A | 9/1956 | Pemetzrieder |
| 2,768,587 | A | 10/1956 | Corneil |
| 2,775,348 | A | 12/1956 | Williams |
| 2,779,574 | A | 1/1957 | Schneider |
| 2,787,873 | A | 4/1957 | Hadley |
| 2,808,782 | A | 10/1957 | Thompson et al. |
| 2,809,107 | A | 10/1957 | Russell |
| 2,821,472 | A | 1/1958 | Peterson et al. |
| 2,824,520 | A | 2/1958 | Bartels |
| 2,832,292 | A | 4/1958 | Edwards |
| 2,853,019 | A | 9/1958 | Thorton |
| 2,865,618 | A | 12/1958 | Abell |
| 2,901,677 | A | 8/1959 | Chessman et al. |
| 2,906,632 | A | 9/1959 | Nickerson |
| 2,918,876 | A | 12/1959 | Howe |
| 2,948,524 | A | 8/1960 | Sweeney et al. |
| 2,958,293 | A | 11/1960 | Pray, Jr. |
| 2,978,885 | A | 4/1961 | Davison |
| 2,984,524 | A | 5/1961 | Franzen |
| 2,987,885 | A | 6/1961 | Hodge |
| 3,010,402 | A | 11/1961 | King |
| 3,015,190 | A | 1/1962 | Arbeit |
| 3,039,864 | A | 6/1962 | Hess |
| 3,044,408 | A | 7/1962 | Mellott |
| 3,048,384 | A | 8/1962 | Sweeney et al. |
| 3,070,393 | A | 12/1962 | Silverberg et al. |
| 3,092,030 | A | 6/1963 | Wunder |
| 3,099,870 | A | 8/1963 | Seeler |
| 3,130,678 | A | 4/1964 | Chenault |
| 3,130,679 | A | 4/1964 | Sence |
| 3,171,357 | A | 3/1965 | Egger |
| 3,172,850 | A | 3/1965 | Englesberg et al. |
| 3,203,182 | A | 8/1965 | Pohl |
| 3,227,547 | A | 1/1966 | Szekely |
| 3,244,109 | A | 4/1966 | Barske |
| 3,251,676 | A | 5/1966 | Johnson |
| 3,255,702 | A | 6/1966 | Gehrm |
| 3,258,283 | A | 6/1966 | Winberg et al. |
| 3,272,619 | A | 9/1966 | Sweeney et al. |
| 3,289,473 | A | 12/1966 | Louda |
| 3,291,473 | A | 12/1966 | Sweeney et al. |
| 3,368,805 | A | 2/1968 | Davey et al. |
| 3,374,943 | A | 3/1968 | Cervenka |
| 3,400,923 | A | 9/1968 | Howie et al. |
| 3,417,929 | A | 12/1968 | Secrest et al. |
| 3,432,336 | A | 3/1969 | Langrod |
| 3,459,133 | A | 8/1969 | Scheffler |
| 3,459,346 | A | 8/1969 | Tinnes |
| 3,477,383 | A | 11/1969 | Rawson et al. |
| 3,487,805 | A | 1/1970 | Satterthwaite |
| 1,185,314 | A | 3/1970 | London |
| 3,512,762 | A | 5/1970 | Umbricht |
| 3,512,788 | A | 5/1970 | Kilbane |
| 3,532,445 | A | 10/1970 | Scheffler et al. |
| 3,561,885 | A | 2/1971 | Lake |
| 3,575,525 | A | 4/1971 | Fox et al. |
| 3,581,767 | A | 6/1971 | Jackson |
| 3,612,715 | A | 10/1971 | Yedidiah |
| 3,618,917 | A | 11/1971 | Fredrikson |
| 3,620,716 | A | 11/1971 | Hess |
| 3,650,730 | A | 3/1972 | Derham et al. |
| 3,689,048 | A | 9/1972 | Foulard et al. |
| 3,715,112 | A | 2/1973 | Carbonnel |
| 3,732,032 | A | 5/1973 | Daneel |
| 3,737,304 | A | 6/1973 | Blayden |
| 3,737,305 | A | 6/1973 | Blayden et al. |
| 3,743,263 | A | 7/1973 | Szekely |
| 3,743,500 | A | 7/1973 | Foulard et al. |
| 3,753,690 | A | 8/1973 | Emley et al. |
| 3,759,628 | A | 9/1973 | Kempf |
| 3,759,635 | A | 9/1973 | Carter et al. |
| 3,767,382 | A | 10/1973 | Bruno et al. |
| 3,776,660 | A | 12/1973 | Anderson et al. |
| 3,785,632 | A | 1/1974 | Kraemer et al. |
| 3,787,143 | A | 1/1974 | Carbonnel et al. |

(56) References Cited

U.S. PATENT DOCUMENTS 3,799,522 A 3/1974 Brant et al.
3,799,523 A 3/1974 Seki
3,807,708 A 4/1974 Jones
3,814,400 A 6/1974 Seki
3,824,028 A 7/1974 Zenkner et al.
3,824,042 A 7/1974 Barnes et al.
3,836,280 A 9/1974 Koch
3,839,019 A 10/1974 Bruno et al.
3,844,972 A 10/1974 Tully, Jr. et al.
3,871,872 A 3/1975 Downing et al.
3,873,073 A 3/1975 Baum et al.
3,873,305 A 3/1975 Claxton et al.
3,881,039 A 4/1975 Baldieri et al.
3,886,992 A 6/1975 Maas et al.
3,915,594 A 10/1975 Nesseth
3,915,694 A 10/1975 Ando
3,941,588 A 3/1976 Dremann
3,941,589 A 3/1976 Norman et al.
3,954,134 A 5/1976 Maas et al.
3,958,979 A 5/1976 Valdo
3,958,981 A 5/1976 Forberg et al.
3,961,778 A 6/1976 Carbonnel et al.
3,966,456 A 6/1976 Ellenbaum et al.
3,967,286 A 6/1976 Andersson et al.
3,972,709 A 8/1976 Chin et al.
3,984,234 A 10/1976 Claxton et al.
3,985,000 A 10/1976 Hartz
3,997,336 A 12/1976 van Linden et al.
4,003,560 A 1/1977 Carbonnel
4,008,884 A 2/1977 Fitzpatrick et al.
4,018,598 A 4/1977 Markus
4,052,199 A 10/1977 Mangalick
4,055,390 A 10/1977 Young
4,063,849 A 12/1977 Modianos
4,068,965 A 1/1978 Lichti
4,091,970 A 5/1978 Kimiyama et al.
4,119,141 A 10/1978 Thut et al.
4,126,360 A 11/1978 Miller et al.
4,128,415 A 12/1978 van Linden et al.
4,169,584 A 10/1979 Mangalick
4,191,486 A 3/1980 Pelton
4,213,742 A 7/1980 Henshaw
4,242,039 A 12/1980 Villard et al.
4,244,423 A 1/1981 Thut et al.
4,286,985 A 9/1981 van Linden et al.
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,356,940 A 11/1982 Ansorge
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,470,846 A 9/1984 Dube
4,474,315 A 10/1984 Gilbert et al.
4,496,393 A 1/1985 Lustenberger
4,504,392 A 3/1985 Groteke
4,509,979 A 4/1985 Bauer
4,537,624 A 8/1985 Tenhover et al.
4,537,625 A 8/1985 Tenhover et al.
4,556,419 A 12/1985 Otsuka et al.
4,557,766 A 12/1985 Tenhover et al.
4,586,845 A 5/1986 Morris
4,592,700 A 6/1986 Toguchi et al.
4,594,052 A 6/1986 Niskanen
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,655,610 A 4/1987 Al-Jaroudi
4,673,434 A 6/1987 Withers et al.
4,684,281 A 8/1987 Patterson
4,685,822 A 8/1987 Pelton
4,696,703 A 9/1987 Henderson et al.
4,701,226 A 10/1987 Henderson et al.
4,702,768 A 10/1987 Areauz et al.
4,714,371 A 12/1987 Cuse
4,717,540 A 1/1988 McRae et al.
4,739,974 A 4/1988 Mordue
4,743,428 A 5/1988 McRae et al.
4,747,583 A 5/1988 Gordon et al.
4,767,230 A 8/1988 Leas, Jr.
4,770,701 A 9/1988 Henderson et al.
4,786,230 A 11/1988 Thut
4,802,656 A 2/1989 Hudault et al.
4,804,168 A 2/1989 Otsuka et al.
4,810,314 A 3/1989 Henderson et al.
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,867,638 A 9/1989 Handtmann et al.
4,884,786 A 12/1989 Gillespie
4,898,367 A 2/1990 Cooper
4,908,060 A 3/1990 Duenkelmann
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,973,433 A 11/1990 Gilbert et al.
4,986,736 A 1/1991 Kajiwara
5,015,518 A 5/1991 Sasaki et al.
5,025,198 A 6/1991 Mordue et al.
5,028,211 A 7/1991 Mordue et al.
5,029,821 A 7/1991 Bar-on et al.
5,078,572 A 1/1992 Amra et al.
5,080,715 A 1/1992 Provencher et al.
5,088,893 A 2/1992 Gilbert et al.
5,092,821 A 3/1992 Gilbert et al.
5,098,134 A 3/1992 Monckton
5,114,312 A 5/1992 Stanislao
5,126,047 A 6/1992 Martin et al.
5,131,632 A 7/1992 Olson
5,143,357 A 9/1992 Gilbert et al.
5,145,322 A 9/1992 Senior, Jr. et al.
5,152,631 A 10/1992 Bauer
5,154,652 A 10/1992 Ecklesdafer
5,158,440 A 10/1992 Cooper et al.
5,162,858 A 11/1992 Shoji et al.
5,165,858 A 11/1992 Gilbert et al.
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,303,903 A 4/1994 Butler et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel

(56) References Cited

U.S. PATENT DOCUMENTS 5,358,549 A 10/1994 Nagel et al.
5,358,697 A 10/1994 Nagel
5,364,078 A 11/1994 Pelton
5,369,063 A 11/1994 Gee et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,495,746 A 3/1996 Sigworth
5,505,143 A 4/1996 Nagel
5,505,435 A 4/1996 Laszlo
5,509,791 A 4/1996 Turner
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,591,243 A 1/1997 Colussi et al.
5,597,289 A 1/1997 Thut
5,613,245 A 3/1997 Robert
5,616,167 A 4/1997 Eckert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwen et al.
5,660,614 A 8/1997 Waite et al.
5,662,725 A * 9/1997 Cooper ..... 266/217
5,676,520 A 10/1997 Thut
5,678,244 A 10/1997 Shaw et al.
5,678,807 A 10/1997 Cooper
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A 2/1998 Thut
5,717,149 A 2/1998 Nagel et al.
5,718,416 A 2/1998 Flisakowski et al.
5,735,668 A 4/1998 Klein
5,735,935 A 4/1998 Areaux
5,741,422 A 4/1998 Eichenmiller et al.
5,744,117 A 4/1998 Wilikinson et al.
5,745,861 A 4/1998 Bell et al.
5,772,324 A 6/1998 Falk
5,776,420 A 7/1998 Nagel
5,785,494 A 7/1998 Vild et al.
5,842,832 A 12/1998 Thut
5,858,059 A 1/1999 Abramovich et al.
5,863,314 A 1/1999 Morando
5,866,095 A 2/1999 McGeever et al.
5,875,385 A 2/1999 Stephenson et al.
5,935,528 A 8/1999 Stephenson et al.
5,944,496 A 8/1999 Cooper
5,947,705 A 9/1999 Mordue et al.
5,951,243 A 9/1999 Cooper
5,963,580 A 10/1999 Eckert
5,992,230 A 11/1999 Scarpa et al.
5,993,726 A 11/1999 Huang
5,993,728 A 11/1999 Vild
6,019,576 A 2/2000 Thut
6,027,685 A 2/2000 Cooper
6,036,745 A 3/2000 Gilbert et al.
6,074,455 A 6/2000 van Linden et al.
6,082,965 A 7/2000 Morando
6,093,000 A 7/2000 Cooper
6,096,109 A 8/2000 Nagel et al.
6,113,154 A 9/2000 Thut
6,123,523 A * 9/2000 Cooper ..... 417/424.1
6,152,691 A 11/2000 Thut
6,168,753 B1 1/2001 Morando
6,187,096 B1 2/2001 Thut
6,199,836 B1 3/2001 Rexford et al.
6,217,823 B1 4/2001 Vild et al.
6,231,639 B1 5/2001 Eichenmiller
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 10/2001 Cooper
6,345,964 B1 2/2002 Cooper
6,354,796 B1 3/2002 Morando
6,358,467 B1 3/2002 Mordue
6,371,723 B1 4/2002 Grant et al.
6,398,525 B1 6/2002 Cooper
6,439,860 B1 8/2002 Greer
6,451,247 B1 9/2002 Mordue et al.
6,457,940 B1 10/2002 Lehman
6,457,950 B1 10/2002 Cooper et al.
6,464,458 B2 10/2002 Vild et al.
6,464,459 B2 10/2002 Illingworth
6,497,559 B1 12/2002 Grant
6,500,228 B1 12/2002 Klingensmith et al.
6,503,292 B2 1/2003 Klingensmith et al.
6,524,066 B2 2/2003 Thut
6,533,535 B2 3/2003 Thut
6,551,060 B2 4/2003 Mordue et al.
6,562,286 B1 5/2003 Lehman
6,679,936 B2 1/2004 Quackenbush
6,689,310 B1 2/2004 Cooper
6,709,234 B2 3/2004 Gilbert et al.
6,723,276 B1 4/2004 Cooper
6,805,834 B2 10/2004 Thut
6,843,640 B2 1/2005 Mordue et al.
6,848,497 B2 2/2005 Sale et al.
6,869,271 B2 3/2005 Gilbert et al.
6,869,564 B2 3/2005 Gilbert et al.
6,881,030 B2 4/2005 Thut
6,887,424 B2 5/2005 Ohno et al.
6,887,425 B2 5/2005 Mordue et al.
6,902,696 B2 6/2005 Klingensmith et al.
7,037,462 B2 5/2006 Klingensmith et al.
7,083,758 B2 8/2006 Tremblay
7,131,482 B2 11/2006 Vincent et al.
7,157,043 B2 1/2007 Neff
7,279,128 B2 10/2007 Kennedy et al.
7,326,028 B2 2/2008 Morando
7,402,276 B2 7/2008 Cooper
7,470,392 B2 12/2008 Cooper
7,476,357 B2 1/2009 Thut
7,497,988 B2 3/2009 Thut
7,507,367 B2 3/2009 Cooper
7,906,068 B2 3/2011 Cooper
8,110,141 B2 2/2012 Cooper
8,137,023 B2 3/2012 Greer
8,142,145 B2 3/2012 Thut
8,328,540 B2 12/2012 Wang
8,333,921 B2 12/2012 Thut
8,361,379 B2 * 1/2013 Cooper ..... 266/239
8,366,993 B2 2/2013 Cooper
8,409,495 B2 4/2013 Cooper
8,440,135 B2 * 5/2013 Cooper ..... 266/235
8,475,594 B2 7/2013 Bright et al.
8,480,950 B2 7/2013 Jetten et al.
8,535,603 B2 9/2013 Cooper
8,580,218 B2 11/2013 Turenne et al.
8,840,359 B2 9/2014 Vick et al.

(56) References Cited

U.S. PATENT DOCUMENTS

| | | | |
|---|---|---|---|
| 8,899,932 | B2 | 12/2014 | Tetkoskie et al. |
| 8,915,830 | B2 | 12/2014 | March et al. |
| 8,920,680 | B2 | 12/2014 | Mao |
| 2001/0000465 | A1 | 4/2001 | Thut |
| 2002/0146313 | A1 | 10/2002 | Thut |
| 2002/0185794 | A1 | 12/2002 | Vincent |
| 2003/0047850 | A1 | 3/2003 | Areaux |
| 2003/0082052 | A1 | 5/2003 | Gilbert et al. |
| 2003/0201583 | A1 | 10/2003 | Klingensmith |
| 2004/0050525 | A1 | 3/2004 | Kennedy et al. |
| 2004/0076533 | A1 | 4/2004 | Cooper |
| 2004/0115079 | A1 | 6/2004 | Cooper |
| 2004/0262825 | A1 | 12/2004 | Cooper |
| 2005/0013713 | A1 | 1/2005 | Cooper |
| 2005/0013714 | A1 | 1/2005 | Cooper |
| 2005/0013715 | A1 | 1/2005 | Cooper |
| 2005/0053499 | A1 | 3/2005 | Cooper |
| 2005/0077730 | A1 | 4/2005 | Thut |
| 2005/0116398 | A1 | 6/2005 | Tremblay |
| 2006/0180963 | A1 | 8/2006 | Thut |
| 2007/0253807 | A1 | 11/2007 | Cooper |
| 2008/0213111 | A1 | 9/2008 | Cooper |
| 2008/0230966 | A1 | 9/2008 | Cooper |
| 2010/0104415 | A1 | 4/2010 | Morando |
| 2011/0140319 | A1 | 6/2011 | Cooper |
| 2011/0142606 | A1 | 6/2011 | Cooper |
| 2011/0148012 | A1 | 6/2011 | Cooper |
| 2012/0163959 | A1 | 6/2012 | Morando |
| 2013/0214014 | A1 | 8/2013 | Cooper |
| 2013/0224038 | A1 | 8/2013 | Tetkoski |
| 2013/0292426 | A1 | 11/2013 | Cooper |
| 2013/0292427 | A1 | 11/2013 | Cooper |
| 2013/0299524 | A1 | 11/2013 | Cooper |
| 2013/0299525 | A1 | 11/2013 | Cooper |
| 2013/0334744 | A1 | 12/2013 | Tremblay et al. |
| 2013/0343904 | A1 | 12/2013 | Cooper |
| 2014/0041252 | A1 | 2/2014 | Vild et al. |
| 2014/0044520 | A1 | 2/2014 | Tipton |
| 2014/0083253 | A1 | 3/2014 | Lutes et al. |
| 2014/0210144 | A1 | 7/2014 | Torres et al. |
| 2014/0232048 | A1 | 8/2014 | Howitt et al. |
| 2014/0363309 | A1 | 12/2014 | Henderson et al. |

FOREIGN PATENT DOCUMENTS

| | | |
|---|---|---|
| CA | 2244251 | 12/1996 |
| CA | 2305865 | 2/2000 |
| CA | 2176475 | 7/2005 |
| CH | 392268 | 9/1965 |
| DE | 1800446 | 12/1969 |
| EP | 0168250 | 1/1986 |
| EP | 0665378 | 2/1995 |
| EP | 1019635 | 6/2006 |
| GB | 942648 | 11/1963 |
| GB | 1185314 | 3/1970 |
| GB | 2217784 | 3/1989 |
| JP | 58048796 | 3/1983 |
| JP | 63104773 | 5/1988 |
| JP | 05112837 | 5/1993 |
| MX | 227385 | 4/2005 |
| NO | 90756 | 1/1959 |
| RU | 416401 | 2/1974 |
| RU | 773312 | 10/1980 |
| WO | WO9808990 | 3/1998 |
| WO | WO9825031 | 6/1998 |
| WO | WO0009889 | 2/2000 |
| WO | WO0212147 | 2/2002 |
| WO | WO2004029307 | 4/2004 |
| WO | 2014055082 | 4/2014 |
| WO | 2014150503 | 9/2014 |
| WO | 2014185971 | 11/2014 |

OTHER PUBLICATIONS

USPTO; Notice of Reissue Examination Certificate dated Aug. 27, 2001 in U.S. Appl. No. 90/005,910.

"Response to Final Office Action and Request for Continued Examination for U.S. Appl. No. 09/275,627," Including Declarations of Haynes and Johnson, Apr. 16, 2001.

Document No. 504217: Excerpts from "Pyrotek Inc.'s Motion for Summary Judgment of Invalidity and Unenforceability of U.S. Patent No. 7,402,276," Oct. 2, 2009.

Document No. 505026: Excerpts from "MMEI's Response to Pyrotek's Motion for Summary Judgment of Invalidity or Enforceability of U.S. Patent No. 7,402,276," Oct. 9, 2009.

Document No. 507689: Excerpts from "MMEI's Pre-Hearing Brief and Supplemental Motion for Summary Judgment of Infringement of Claims 3-4, 15, 17-20, 26 and 28-29 of the '074 Patent and Motion for Reconsideration of the Validity of Claims 7-9 of the '276 Patent," Nov. 4, 2009.

Document No. 517158: Excerpts from "Reasoned Award," Feb. 19, 2010.

Document No. 525055: Excerpts from "Molten Metal Equipment Innovations, Inc.'s Reply Brief in Support of Application to Confirm Arbitration Award and Opposition to Motion to Vacate," May 12, 2010.

USPTO; Office Action dated Feb. 23, 1996 in U.S. Appl. No. 08/439,739.

USPTO; Office Action dated Aug. 15, 1996 in U.S. Appl. No. 08/439,739.

USPTO; Advisory Action dated Nov. 18, 1996 in U.S. Appl. No. 08/439,739.

USPTO; Advisory Action dated Dec. 9, 1996 in U.S. Appl. No. 08/439,739.

USPTO; Notice of Allowance dated Jan. 17, 1997 in U.S. Appl. No. 08/439,739.

USPTO; Office Action dated Jul. 22, 1996 in U.S. Appl. No. 08/489,962.

USPTO; Office Action dated Jan. 6, 1997 in U.S. Appl. No. 08/489,962.

USPTO; Interview Summary dated Mar. 4, 1997 in U.S. Appl. No. 08/489,962.

USPTO; Notice of Allowance dated Mar. 27, 1997 in U.S. Appl. No. 08/489,962.

USPTO; Office Action dated Sep. 23, 1998 in U.S. Appl. No. 08/759,780.

USPTO; Interview Summary dated Dec. 30, 1998 in U.S. Appl. No. 08/789,780.

USPTO; Notice of Allowance dated Mar. 17, 1999 in U.S. Appl. No. 08/789,780.

USPTO; Office Action dated Jul. 23, 1998 in U.S. Appl. No. 08/889,882.

USPTO; Office Action dated Jan. 21, 1999 in U.S. Appl. No. 08/889,882.

USPTO; Notice of Allowance dated Mar. 17, 1999 in U.S. Appl. No. 08/889,882.

USPTO; Office Action dated Feb. 26, 1999 in U.S. Appl. No. 08/951,007.

USPTO; Interview Summary dated Mar. 15, 1999 in U.S. Appl. No. 08/951,007.

USPTO; Office Action dated May 17, 1999 in U.S. Appl. No. 08/951,007.

USPTO; Notice of Allowance dated Aug. 27, 1999 in U.S. Appl. No. 08/951,007.

USPTO; Office Action dated Dec. 23, 1999 in U.S. Appl. No. 09/132,934.

USPTO; Notice of Allowance dated Mar. 9, 2000 in U.S. Appl. No. 09/132,934.

USPTO; Office Action dated Jan. 7, 2000 in U.S. Appl. No. 09/152,168.

USPTO; Notice of Allowance dated Aug. 7, 2000 in U.S. Appl. No. 09/152,168.

USPTO; Office Action dated Sep. 29, 1999 in U.S. Appl. No. 09/275,627.

USPTO; Office Action dated May 22, 2000 in U.S. Appl. No. 09/275,627.

USPTO; Office Action dated Nov. 14, 2000 in U.S. Appl. No. 09/275,627.

(56) References Cited

OTHER PUBLICATIONS

USPTO; Office Action dated May 21, 2001 in U.S. Appl. No. 09/275,627.
USPTO; Notice of Allowance dated Aug. 31, 2001 in U.S. Appl. No. 09/275,627.
USPTO; Office Action dated Jun. 15, 2000 in U.S. Appl. No. 09/312,361.
USPTO; Notice of Allowance dated Jan. 29, 2001 in U.S. Appl. No. 09/312,361.
USPTO; Office Action dated Jun. 22, 2001 in U.S. Appl. No. 09/569,461.
USPTO; Office Action dated Oct. 12, 2001 in U.S. Appl. No. 09/569,461.
USPTO; Office Action dated May 3, 2002 in U.S. Appl. No. 09/569,461.
USPTO; Advisory Action dated May 14, 2002 in U.S. Appl. No. 09/569,461.
USPTO; Office Action dated Dec. 4, 2002 in U.S. Appl. No. 09/569,461.
USPTO; Interview Summary dated Jan. 14, 2003 in U.S. Appl. No. 09/569,461.
USPTO; Notice of Allowance dated Jun. 24, 2003 in U.S. Appl. No. 09/569,461.
USPTO; Office Action dated Nov. 21, 2000 in U.S. Appl. No. 09/590,108.
USPTO; Office Action dated May 22, 2001 in U.S. Appl. No. 09/590,108.
USPTO; Notice of Allowance dated Sep. 10, 2001 in U.S. Appl. No. 09/590,108.
USPTO; Office Action dated Jan. 30, 2002 in U.S. Appl. No. 09/649,190.
USPTO; Office Action dated Oct. 4, 2002 in U.S. Appl. No. 09/649,190.
USPTO; Office Action dated Apr. 18, 2003 in U.S. Appl. No. 09/649,190.
USPTO; Notice of Allowance dated Nov. 21, 2003 in U.S. Appl. No. 09/649,190.
USPTO; Office Action dated Jun. 7, 2006 in U.S. Appl. No. 10/619,405.
USPTO; Final Office Action dated Feb. 20, 2007 in U.S. Appl. No. 10/619,405.
USPTO; Office Action dated Oct. 9, 2007 in U.S. Appl. No. 10/619,405.
USPTO; Final Office Action dated May 29, 2008 in U.S. Appl. No. 10/619,405.
USPTO; Interview Summary Aug. 22, 2008 in U.S. Appl. No. 10/619,405.
USPTO; Ex Parte Quayle dated Sep. 12, 2008 in U.S. Appl. No. 10/619,405.
USPTO; Interview Summary dated Oct. 16, 2008 in U.S. Appl. No. 10/619,405.
USPTO; Notice of Allowance dated Nov. 14, 2008 in U.S. Appl. No. 10/619,405.
USPTO; Office Action dated Mar. 20, 2006 in U.S. Appl. No. 10/620,318.
USPTO; Office Action dated Nov. 16, 2006 in U.S. Appl. No. 10/620,318.
USPTO; Final Office Action dated Jul. 25, 2007 in U.S. Appl. No. 10/620,318.
USPTO; Office Action dated Feb. 12, 2008 in U.S. Appl. No. 10/620,318.
USPTO; Final Office Action dated Oct. 16, 2008 in U.S. Appl. No. 10/620,318.
USPTO; Office Action dated Feb. 25, 2009 in U.S. Appl. No. 10/620,318.
USPTO; Final Office Action dated Oct. 8, 2009 in U.S. Appl. No. 10/620,318.
USPTO; Notice of Allowance Jan. 26, 2010 in U.S. Appl. No. 10/620,318.
USPTO; Office Action dated Nov. 15, 2007 in U.S. Appl. No. 10/773,101.
USPTO; Office Action dated Jun. 27, 2006 in U.S. Appl. No. 10/773,102.
USPTO; Final Office Action dated Mar. 6, 2007 in U.S. Appl. No. 10/773,102.
USPTO; Office Action dated Oct. 11, 2007 in U.S. Appl. No. 10/773,102.
USPTO; Interview Summary dated Mar. 18, 2008 in U.S. Appl. No. 10/773,102.
USPTO; Notice of Allowance dated Apr. 18, 2008 in U.S. Appl. No. 10/773,102.
USPTO; Office Action dated Jul. 24, 2006 in U.S. Appl. No. 10/773,105.
USPTO; Office Action dated Oct. 9, 2007 in U.S. Appl. No. 10/773,105.
USPTO; Interview Summary dated Jan. 25, 2008 in U.S. Appl. No. 10/773,105.
USPTO; Office Action dated May 19, 2008 in U.S. Appl. No. 10/773,105.
USPTO; Interview Summary dated Jul. 21, 2008 in U.S. Appl. No. 10/773,105.
USPTO; Notice of Allowance dated Sep. 29, 2008 in U.S. Appl. No. 10/773,105.
USPTO; Office Action dated Jan. 31, 2008 in U.S. Appl. No. 10/773,118.
USPTO; Final Office Action dated Aug. 18, 2008 in U.S. Appl. No. 10/773,118.
USPTO; Interview Summary dated Oct. 16, 2008 in U.S. Appl. No. 10/773,118.
USPTO; Office Action dated Dec. 15, 2008 in U.S. Appl. No. 10/773,118.
USPTO; Final Office Action dated May 1, 2009 in U.S. Appl. No. 10/773,118.
USPTO; Office Action dated Jul. 27, 2009 in U.S. Appl. No. 10/773,118.
USPTO; Final Office Action dated Feb. 2, 2010 in U.S. Appl. No. 10/773,118.
USPTO; Interview Summary dated Jun. 4, 2010 in U.S. Appl. No. 10/773,118.
USPTO; Ex Parte Quayle Action dated Aug. 25, 2010 in U.S. Appl. No. 10/773,118.
USPTO; Notice of Allowance dated Nov. 5, 2010 in U.S. Appl. No. 10/773,118.
USPTO; Office Action dated Mar. 16, 2005 in U.S. Appl. No. 10/827,941.
USPTO; Final Office Action dated Nov. 7, 2005 in U.S. Appl. No. 10/827,941.
USPTO; Office Action dated Jul. 12, 2006 in U.S. Appl. No. 10/827,941.
USPTO; Final Office Action dated Mar. 8, 2007 in U.S. Appl. No. 10/827,941.
USPTO; Office Action dated Oct. 29, 2007 in U.S. Appl. No. 10/827,941.
USPTO; Office Action dated Sep. 26, 2008 in U.S. Appl. No. 11/413,982.
USPTO; Office Action dated Dec. 11, 2009 in U.S. Appl. No. 11/766,617.
USPTO; Office Action dated Mar. 8, 2010 in U.S. Appl. No. 11/766,617.
USPTO; Final Office Action dated Sep. 20, 2010 in U.S. Appl. No. 11/766,617.
USPTO; Office Action dated Mar. 1, 2011 in U.S. Appl. No. 11/766,617.
USPTO; Final Office Action dated Sep. 22, 2011 in U.S. Appl. No. 11/766,617.
USPTO; Office Action dated Jan. 27, 2012 in U.S. Appl. No. 11/766,617.
USPTO; Notice of Allowance dated May 15, 2012 in U.S. Appl. No. 11/766,617.
USPTO; Supplemental Notice of Allowance dated Jul. 31, 2012 in U.S. Appl. No. 11/766,617.

(56) References Cited

OTHER PUBLICATIONS

USPTO; Notice of Allowance dated Aug. 24, 2012 in U.S. Appl. No. 11/766,617.
USPTO; Final Office Action dated Oct. 14, 2008 in U.S. Appl. No. 12/111,835.
USPTO; Office Action dated May 15, 2009 in U.S. Appl. No. 12/111,835.
USPTO; Office Action dated Mar. 31, 2009 in U.S. Appl. No. 12/120,190.
USPTO; Final Office Action dated Dec. 4, 2009 in U.S. Appl. No. 12/120,190.
USPTO; Office Action dated Jun. 28, 2010 in U.S. Appl. No. 12/120,190.
USPTO; Final Office Action dated Jan. 6, 2011 in U.S. Appl. No. 12/120,190.
USPTO; Office Action dated Jun. 27, 2011 in U.S. Appl. No. 12/120,190.
USPTO; Final Office Action dated Nov. 28, 2011 in U.S. Appl. No. 12/120,190.
USPTO; Notice of Allowance dated Feb. 6, 2012 in U.S. Appl. No. 12/120,190.
USPTO; Office Action dated Nov. 3, 2008 in U.S. Appl. No. 12/120,200.
USPTO; Final Office Action dated May 28, 2009 in U.S. Appl. No. 12/120,200.
USPTO; Office Action dated Dec. 18, 2009 in U.S. Appl. No. 12/120,200.
USPTO; Final Office Action dated Jul. 9, 2010 in U.S. Appl. No. 12/120,200.
USPTO; Office Action dated Jan. 21, 2011 in U.S. Appl. No. 12/120,200.
USPTO; Final Office Action dated Jul. 26, 2011 in U.S. Appl. No. 12/120,200.
USPTO; Final Office Action dated Feb. 3, 2012 in U.S. Appl. No. 12/120,200.
USPTO; Notice of Allowance dated Jan. 17, 2013 in U.S. Appl. No. 12/120,200.
USPTO; Office Action dated Jun. 16, 2009 in U.S. Appl. No. 12/146,770.
USPTO; Final Office Action dated Feb. 24, 2010 in U.S. Appl. No. 12/146,770.
USPTO; Office Action dated Jun. 9, 2010 in U.S. Appl. No. 12/146,770.
USPTO; Office Action dated Nov. 18, 2010 in U.S. Appl. No. 12/146,770.
USPTO; Final Office Action dated Apr. 4, 2011 in U.S. Appl. No. 12/146,770.
USPTO; Notice of Allowance dated Aug. 22, 2011 in U.S. Appl. No. 12/146,770.
USPTO; Notice of Allowance dated Nov. 1, 2011 in U.S. Appl. No. 12/146,770.
USPTO; Office Action dated Apr. 27, 2009 in U.S. Appl. No. 12/146,788.
USPTO; Final Office Action dated Oct. 15, 2009 in U.S. Appl. No. 12/146,788.
USPTO; Office Action dated Feb. 16, 2010 in U.S. Appl. No. 12/146,788.
USPTO; Final Office Action dated Jul. 13, 2010 in U.S. Appl. No. 12/146,788.
USPTO; Office Action dated Apr. 19, 2011 in U.S. Appl. No. 12/146,788.
USPTO; Notice of Allowance dated Aug. 19, 2011 in U.S. Appl. No. 12/146,788.
USPTO; Office Action dated Apr. 13, 2009 in U.S. Appl. No. 12/264,416.
USPTO; Final Office Action dated Oct. 8, 2009 in U.S. Appl. No. 12/264,416.
USPTO; Office Action dated Feb. 1, 2010 in U.S. Appl. No. 12/264,416.
USPTO; Final Office Action dated Jun. 30, 2010 in U.S. Appl. No. 12/264,416.
USPTO; Office Action dated Mar. 17, 2011 in U.S. Appl. No. 12/264,416.
USPTO; Final Office Action dated Jul. 7, 2011 in U.S. Appl. No. 12/264,416.
USPTO; Office Action dated Nov. 4, 2011 in U.S. Appl. No. 12/264,416.
USPTO; Final Office Action dated Jun. 8, 2012 in U.S. Appl. No. 12/264,416.
USPTO; Office Action dated Nov. 28, 2012 in U.S. Appl. No. 12/264,416.
USPTO; Ex Parte Quayle dated Apr. 3, 2013 in U.S. Appl. No. 12/264,416.
USPTO; Notice of Allowance dated Jun. 23, 2013 in U.S. Appl. No. 12/264,416.
USPTO; Office Action dated May 22, 2009 in U.S. Appl. No. 12/369,362.
USPTO; Final Office Action dated Dec. 14, 2009 in U.S. Appl. No. 12/369,362.
USPTO; Final Office Action dated Jun. 11, 2010 in U.S. Appl. No. 12/395,430.
USPTO; Office Action dated Nov. 24, 2010 in U.S. Appl. No. 12/395,430.
USPTO; Final Office Action dated Apr. 6, 2011 in U.S. Appl. No. 12/395,430.
USPTO; Office Action dated Aug. 18, 2011 in U.S. Appl. No. 12/395,430.
USPTO; Final Office Action dated Dec. 13, 2011 in U.S. Appl. No. 12/395,430.
USPTO; Advisory Action dated Feb. 22, 2012 in U.S. Appl. No. 12/395,430.
USPTO; Notice of Allowance dated Sep. 20, 2012 in U.S. Appl. No. 12/395,430.
USPTO; Office Action dated Sep. 29, 2010 in U.S. Appl. No. 12/758,509.
USPTO; Final Office Action dated May 11, 2011 in U.S. Appl. No. 12/758,509.
USPTO; Office Action dated Feb. 1, 2012 in U.S. Appl. No. 12/853,201.
USPTO; Final Office Action dated Jul. 3, 2012 in U.S. Appl. No. 12/853,201.
USPTO; Notice of Allowance dated Jan. 31, 2013 in U.S. Appl. No. 12/853,201.
USPTO; Office Action dated Jan. 3, 2013 in U.S. Appl. No. 12/853,238.
USPTO; Office Action dated Feb. 27, 2012 in U.S. Appl. No. 12/853,253.
USPTO; Ex Parte Quayle Action dated Jun. 27, 2012 in U.S. Appl. No. 12/853,253.
USPTO; Notice of Allowance dated Oct. 2, 2012 in U.S. Appl. No. 12/853,253.
USPTO; Office Action dated Mar. 12, 2012 in U.S. Appl. No. 12/853,255.
USPTO; Final Office Action dated Jul. 24, 2012 in U.S. Appl. No. 12/853,255.
USPTO; Office Action dated Jan. 18, 2013 in U.S. Appl. No. 12/853,255.
USPTO; Notice of Allowance dated Jun. 20, 2013 in U.S. Appl. No. 12/853,255.
USPTO; Office Action dated Apr. 19, 2012 in U.S. Appl. No. 12/853,268.
USPTO; Final Office Action dated Sep. 17, 2012 in U.S. Appl. No. 12/853,268.
USPTO; Notice of Allowance dated Nov. 21, 2012 in U.S. Appl. No. 12/853,268.
USPTO; Office Action dated May 29, 2012 in U.S. Appl. No. 12/878,984.
USPTO; Office Action dated Oct. 3, 2012 in U.S. Appl. No. 12/878,984.
USPTO; Final Office Action dated Jan. 25, 2013 in U.S. Appl. No. 12/878,984.

(56) References Cited

OTHER PUBLICATIONS

USPTO; Notice of Allowance dated Mar. 28, 2013 in U.S. Appl. No. 12/878,984.
USPTO; Office Action dated Sep. 22, 2011 in U.S. Appl. No. 12/880,027.
USPTO; Final Office Action dated Feb. 16, 2012 in U.S. Appl. No. 12/880,027.
USPTO; Office Action dated Dec. 14, 2012 in U.S. Appl. No. 12/880,027.
USPTO; Final Office Action dated Jul. 11, 2013 in U.S. Appl. No. 12/880,027.
USPTO; Office Action dated Aug. 25, 2011 in U.S. Appl. No. 13/047,719.
USPTO; Final Office Action dated Dec. 16, 2011 in U.S. Appl. No. 13/047,719.
USPTO; Office Action dated Sep. 11, 2012 in U.S. Appl. No. 13/047,719.
USPTO; Notice of Allowance dated Feb. 28, 2013 in U.S. Appl. No. 13/047,719.
USPTO; Office Action dated Aug. 25, 2011 in U.S. Appl. No. 13/047,747.
USPTO; Final Office Action dated Feb. 7, 2012 in U.S. Appl. No. 13/047,747.
USPTO; Notice of Allowance dated Apr. 18, 2012 in U.S. Appl. No. 13/047,747.
USPTO; Office Action dated Dec. 13, 2012 in U.S. Appl. No. 13/047,747.
USPTO; Notice of Allowance dated Apr. 3, 2013 in U.S. Appl. No. 13/047,747.
USPTO; Office Action dated Apr. 12, 2013 in U.S. Appl. No. 13/106,853.
USPTO; Notice of Allowance dated Aug. 23, 2013 in U.S. Appl. No. 13/106,853.
USPTO; Office Action dated Apr. 18, 2012 in U.S. Appl. No. 13/252,145.
USPTO; Final Office Action dated Sep. 17, 2012 in U.S. Appl. No. 13/252,145.
USPTO; Notice of Allowance dated Nov. 30, 2012 in U.S. Appl. No. 13/252,145.
USPTO; Office Action dated Aug. 1, 2013 in U.S. Appl. No. 12/877,988.
USPTO; Office Action dated Sep. 11, 2013 in U.S. Appl. No. 13/756,468.
USPTO; Office Action dated Sep. 6, 2013 in U.S. Appl. No. 13/725,383.
USPTO; Office Action dated Oct. 24, 2013 in U.S. Appl. No. 13/725,383.
CIPO; Office Action dated Dec. 4, 2001 in Application No. 2,115,929.
CIPO; Office Action dated Apr. 22, 2002 in Application No. 2,115,929.
CIPO; Notice of Allowance dated Jul. 18, 2003 in Application No. 2,115,929.
CIPO; Office Action dated Jun. 30, 2003 in Application No. 2,176,475.
CIPO; Notice of Allowance dated Sep. 15, 2004 in Application No. 2,176,475.
CIPO; Office Action dated May 29, 2000 in Application No. 2,242,174.
CIPO; Office Action dated Feb. 22, 2006 in Application No. 2,244,251.
CIPO; Office Action dated Mar. 27, 2007 in Application No. 2,244,251.
CIPO; Office Action dated Sep. 18, 2002 in Application No. 2,305,865.
CIPO; Notice of Allowance dated May 2, 2003 in Application No. 2,305,865.
EPO; Examination Report dated Oct. 6, 2008 in Application No. 08158682.
EPO; Office Action dated Jan. 26, 2010 in Application No. 08158682.
EPO; Office Action dated Feb. 15, 2011 in Application No. 08158682.
EPO; Search Report dated Nov. 9, 1998 in Application No. 98112356.
EPO; Office Action dated Feb. 6, 2003 in Application No. 99941032.
EPO; Office Action dated Aug. 20, 2004 in Application No. 99941032.
PCT; International Search Report or Declaration dated Nov. 15, 1999 in Application No. PCT/US1999/18178.
PCT; International Search Report or Declaration dated Oct. 9, 1998 in Application No. PCT/US1999/22440.
USPTO; Notice of Allowance dated Feb. 4, 2015 in U.S. Appl. No. 13/797,616.
USPTO; Final Office Action dated Jun. 3, 2014 in U.S. Appl. No. 12/895,796.
USPTO; Office Action dated Jul. 16, 2014 in U.S. Appl. No. 12/880,027.
USPTO; Final Office Action dated May 19, 2014 in U.S. Appl. No. 12/853,238.
USPTO; Office Action dated Aug. 14, 2014 in U.S. Appl. No. 13/791,889.
USPTO; Office Action dated Sep. 10, 2014 in U.S. Appl. No. 13/791,952.
USPTO; Office Action dated Sep. 15, 2014 in U.S. Appl. No. 13/797,616.
USPTO; Restriction Requirement dated Sep. 17, 2014 in U.S. Appl. No. 13/801,907.
USPTO; Restriction Requirement dated Sep. 17, 2014 in U.S. Appl. No. 13/802,203.
USPTO; Office Action dated Sep. 22, 2014 in U.S. Appl. No. 13/830,031.
USPTO; Office Action dated Sep. 23, 2014 in U.S. Appl. No. 13/843,947.
USPTO; Office Action dated Sep. 25, 2014 in U.S. Appl. No. 13/838,601.
USPTO; Office Action dated Nov. 28, 2014 in U.S. Appl. No. 13/843,947.
USPTO; Office Action dated Nov. 17, 2014 in U.S. Appl. No. 12/895,796.
USPTO; Final Office Action dated Dec. 5, 2014 in U.S. Appl. No. 13/791,889.
USPTO; Office Action dated Dec. 9, 2014 in U.S. Appl. No. 13/801,907.
USPTO; Office Action dated Dec. 11, 2014 in U.S. Appl. No. 13/802,203.
USPTO; Ex Parte Quayle Office Action dated Dec. 19, 2014 in U.S. Appl. No. 12/880,027.
USPTO; Office Action dated Jan. 9, 2015 in U.S. Appl. No. 13/802,040.
USPTO; Office Action dated Feb. 13, 215 in U.S. Appl. No. 13/973,962.
USPTO; Office Action dated Mar. 3, 2015 in U.S. Appl. No. 13/725,383.
USPTO; Final Office Action dated Mar. 3, 2015 in U.S. Appl. No. 13/838,601.
USPTO; Notice of Allowance dated Jan. 30, 2015 in U.S. Appl. No. 13/830,031.

* cited by examiner

GAS-TRANSFER FOOT

RELATED APPLICATIONS

This application is a continuation of and claims priority to U.S. application Ser. No. 12/395,430 filed Feb. 27, 2009 (now U.S. Pat. No. 8,361,379), which is a continuation of and claims priority to U.S. application Ser. No. 11/413,982 filed Apr. 28, 2006 (now abandoned) and U.S. application Ser. No. 12/120,190 filed May 13, 2008, now U.S. Pat. No. 8,178,037 issued May 15, 2012, which is a continuation of U.S. application Ser. No. 10/773,101 filed Feb. 4, 2004 (now abandoned), which is a continuation of and claims priority to U.S. application Ser. No. 10/619,405 filed Jul. 14, 2003, now U.S. Pat. No. 7,507,367 issued Mar. 24, 2009, and U.S. application Ser. No. 10/620,318 filed Jul. 14, 2003, now U.S. Pat. No. 7,731,891 issued Jun. 8, 2010, both of which claim priority to U.S. Provisional Patent Application Ser. No. 60/395,471, filed Jul. 12, 2002, the disclosures of which are incorporated herein by reference in their entirety for all purposes.

FIELD OF THE INVENTION

The invention relates to releasing gas into molten metal and more particularly, to a device for releasing gas into the bottom of a stream of molten metal that may utilize the flow of the molten metal stream to assist in drawing the gas into the stream. In this manner, the gas may be more effectively mixed into the molten metal.

BACKGROUND OF THE INVENTION

As used herein, the term "molten metal" means any metal or combination of metals in liquid form, such as aluminum, copper, iron, zinc and alloys thereof. The term "gas" means any gas or combinations of gases, including argon, nitrogen, chlorine, fluorine, Freon, and helium, which are released into molten metal.

Known pumps for pumping molten metal (also called "molten metal pumps") include a pump base (also called a housing or casing), one or more inlets, an inlet being an opening to allow molten metal to enter a pump chamber (and is usually an opening in the pump base that communicates with the pump chamber), a pump chamber, which is an open area formed within the pump base, and a discharge, which is a channel or conduit communicating with the pump chamber (in an axial pump the pump chamber and discharge may be the same structure or different areas of the same structure) leading from the pump chamber to the molten metal bath in which the pump base is submerged. A rotor, also called an impeller, is mounted in the pump chamber and is connected to a drive shaft. The drive shaft is typically a motor shaft coupled to a rotor shaft, wherein the motor shaft has two ends, one end being connected to a motor and the other end being coupled to the rotor shaft. The rotor shaft also has two ends, wherein one end is coupled to the motor shaft and the other end is connected to the rotor. Often, the rotor shaft is comprised of graphite, the motor shaft is comprised of steel, and the two are coupled by a coupling, which is usually comprised of steel.

As the motor turns the drive shaft, the drive shaft turns the rotor and the rotor pushes molten metal out of the pump chamber, through the discharge, which may be an axial, tangential or any type of discharge, and into the molten metal bath. Most molten metal pumps are gravity fed, wherein gravity forces molten metal through the inlet (either a top inlet, bottom inlet or both) and into the pump chamber as the rotor pushes molten metal out of the pump chamber.

Molten metal pump casings and rotors usually employ a bearing system comprising ceramic rings wherein there is one or more rings on the rotor that align with rings in the pump chamber (such as rings at the inlet (which is usually at the top of the pump chamber and/or bottom of the pump chamber) when the rotor is placed in the pump chamber. The purpose of the bearing system is to reduce damage to the soft, graphite components, particularly the rotor and pump chamber wall, during pump operation. Known bearing systems are described in U.S. Pat. Nos. 5,203,681, 5,591,243 and 6,093,000 to Cooper, the respective disclosures of which are incorporated herein by reference. Further, U.S. Pat. No. 2,948,524 to Sweeney et al., U.S. Pat. No. 4,169,584 to Mangalick, U.S. Pat. No. 5,203,681 to Cooper and U.S. Pat. No. 6,123,523 to Cooper (the disclosure of U.S. Pat. No. 6,123,533 to Cooper is also incorporated herein by reference) all disclose molten metal pumps.

Furthermore, copending U.S. patent application Ser. No. 10/773,102 to Cooper, filed on Feb. 4, 2004 and entitled "Pump With Rotating Inlet" discloses, among other things, a pump having an inlet and rotor structure (or other displacement structure) that rotate together as the pump operates in order to alleviate jamming. The disclosure of this copending application is incorporated herein by reference.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of a charging well where scrap metal is charged (i.e., added).

Transfer pumps are generally used to transfer molten metal from the external well of a reverbatory furnace to a different location such as a ladle or another furnace. Examples of transfer pumps are disclosed in U.S. Pat. No. 6,345,964 B1 to Cooper, the disclosure of which is incorporated herein by reference, and U.S. Pat. No. 5,203,681.

Gas-release pumps, such as gas-transfer pumps, circulate molten metal while releasing a gas into the molten metal. In the purification of molten metals, particularly aluminum, it is frequently desired to remove dissolved gases such as hydrogen, or dissolved metals, such as magnesium, from the molten metal. As is known by those skilled in the art, the removing of dissolved gas is known as "degassing" while the removal of magnesium is known as "demagging." Gas-release pumps may be used for either of these purposes or for any other application for which it is desirable to introduce gas into molten metal. Gas-release pumps generally include a gas-transfer conduit having a first end that is connected to a gas source and a second submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where it enters the pump chamber. A system for releasing gas into a pump chamber is disclosed in U.S. Pat. No. 6,123,523 to Cooper, and in copending U.S. application Ser. No. 10/773,101 entitled System for Releasing Gas Into Molten Metal filed on Feb. 4, 2004.

The advantage of a system for releasing gas into molten metal within the confines of a metal-transfer conduit is that the gas and metal should have a better opportunity to thoroughly interact. One problem with releasing gas into a metal-transfer conduit is that, in some systems, the conduit (called a gas-transfer conduit) that transfers the gas from a gas source into the molten metal stream typically extends into the metal-transfer conduit, usually extending downward from the top of the metal-transfer conduit, and disrupts the flow of molten metal passing through the conduit and creating a low-pressure area behind the portion of the gas-transfer conduit extending into the metal-transfer conduit. The low-pressure area can interfere with the released gas mixing with molten metal passing through the metal-transfer conduit because, among other things, the gas immediately rises into the low-pressure area instead of mixing with molten metal throughout the metal-transfer conduit. This can create a phenomenon known as "burping" because a large gas bubble will build up in the low pressure area and then be released from the discharge instead of thoroughly mixing with the molten metal.

SUMMARY OF THE INVENTION

The present invention includes a molten metal pump that enables gas to be released into a stream of molten metal so that the gas is mixed into the molten metal stream. The gas may be released into an enclosed molten metal stream at location(s) within the pump assembly, including at a stream within the pump discharge and/or a stream within a metal-transfer conduit extending from the pump discharge. The gas is released by a structure called a "gas-transfer foot." The gas-transfer foot is positioned next to and/or is attachable to the pump base and/or a metal-transfer conduit extending from the pump base.

The discharge (pump base) and/or channel (metal-transfer conduit) in which the gas is released may be comprised of two sections: a first section having a first cross-sectional area and a second section downstream from the first section having a second cross-sectional area that is larger than the first cross-sectional area. Preferably, the gas is released into or near the second section so that the gas is released into an area of relatively lower pressure.

The gas-transfer foot preferably includes a gas inlet port through which gas enters the foot and a gas outlet port through which gas exits the foot. The gas-transfer foot may be configured to be attachable to a pump base and/or metal-transfer conduit such that gas exiting the outlet port can enter the bottom of a stream of molten metal. The gas-transfer foot is preferably coupled to a gas-transfer tube to form a gas-transfer assembly. The gas-transfer tube includes a first end connectable to the inlet port of the foot and a second end connectable to a gas source.

For example, the gas-transfer foot may be attachable to a base of a molten metal pump. In that case the gas-release opening is preferably on the bottom surface of the discharge that is in communication with either the first section, the second section, or both the first and second sections.

The gas-transfer foot may also be attachable to a metal-transfer conduit, which may extend form the pump discharge. The metal-transfer conduit includes an inlet port, an outlet port, a conduit, and a gas-release opening. The inlet port is in communication with the base discharge. The outlet port is downstream from the inlet port and is connected to the inlet port via the conduit. The conduit preferably has a bottom surface and includes a first section having a first cross-sectional area and a second section having a second cross-sectional area. The second section is downstream of the first section and the second cross-sectional area is greater than the first cross-sectional area. The opening is preferably positioned on the bottom surface of the metal-transfer conduit and is in communication with either the first section, the second section, or both the first and second sections. The gas outlet port of the foot is in communication with the opening in the metal so that gas can be transferred from the gas outlet port through the opening and into the conduit.

The base of the molten metal pump configured to receive a gas-transfer foot according to the invention. Such a base includes a gas-transfer foot notch or ("notch") to receive the foot and position it such that the gas exiting the gas-release opening in the foot enters the molten metal stream in the pump base. The opening is preferably on the bottom surface of the discharge and enables gas to enter the bottom of the discharge. The notch is preferably constructed so that gas-transfer foot is positioned so that gas exiting the outlet port enters a relatively lower pressure section of the molten metal stream.

The metal-transfer conduit may be configured to receive a gas-transfer foot. The notch is preferably constructed so that the gas outlet port of a gas-transfer foot is in communication with the gas-release opening when the gas-transfer foot is inserted into the notch.

Both the foregoing general description and the following detailed description are exemplary and explanatory only and are not restrictive of the invention as claimed.

DETAILED DESCRIPTION OF PREFERRED EMBODIMENTS

Figure 1A:
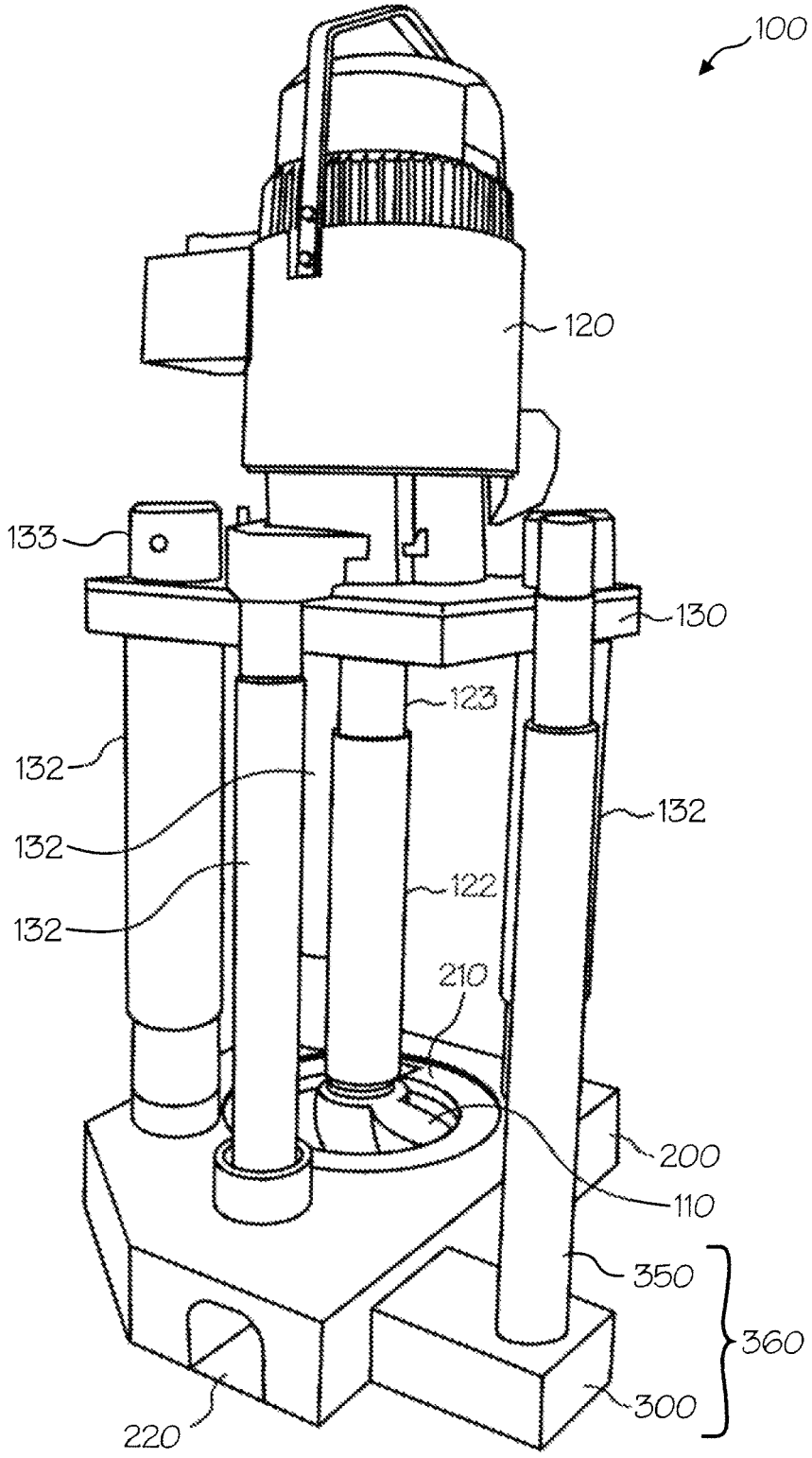
FIG. 1A depicts a molten metal pump according to one embodiment of the invention.

Reference will now be made in detail to the present exemplary embodiments of the invention, examples of which are illustrated in the accompanying drawings. FIG. 1A depicts a molten metal pump 100 according to the invention. When in operation, pump 100 is typically positioned in a molten metal bath in a pump well, which is typically part of the open well of a reverbatory furnace. Pump 100 includes motor 120, superstructure 130, support posts 132, drive shaft 122, rotor 110, base 200, gas-transfer foot 300 and gas-transfer tube 350.

The components of pump 100 that are exposed to the molten metal (such as support posts 132, drive shaft 122, rotor 110, base 200, gas-transfer foot 300 and gas-transfer tube 350) are preferably formed of structural refractory materials, which are resistant to degradation in the molten metal. Carbonaceous refractory materials, such as carbon of a dense or structural type, including graphite, graphitized carbon, clay-bonded graphite, carbon-bonded graphite, or the like have all been found to be most suitable because of cost and ease of machining. Such components may be made by mixing ground graphite with a fine clay binder, forming the non-coated component and baking, and may be glazed or unglazed. In addition, components made of carbonaceous refractory materials may be treated with one or more chemicals to make the components more resistant to oxidation. Oxidation and erosion treatment for graphite parts are practiced commercially, and graphite so treated can be obtained from sources known to those skilled in the art.

Pump 100 need not be limited to the structure depicted in FIG. 1A, but can be any structure or device for pumping or otherwise conveying molten metal, such as the pump disclosed in U.S. Pat. No. 5,203,681 to Cooper, or an axial pump having an axial, rather than tangential, discharge. Preferred pump 100 has a pump base 200 for being submersed in a molten metal bath. Pump base 200 preferably includes a generally nonvolute pump chamber 210, such as a cylindrical pump chamber or what has been called a "cut" volute, although pump base 200 may have any shape pump chamber suitable of being used, including a volute-shaped chamber. Chamber 210 may be constructed to have only one opening, either in its top or bottom, if a tangential discharge is used, since only one opening is required to introduce molten metal into pump chamber 210. Generally, pump chamber 210 has two coaxial openings of the same diameter and usually one is blocked by a flow blocking plate mounted on, or formed as part of, rotor 110. Base 200 further includes a tangential discharge 220 (although another type of discharge, such as an axial discharge may be used) in fluid communication with chamber 210. Base 200 will be described in more detail below with reference to FIGS. 2A and 2B.

One or more support posts 132 connect base 200 to a superstructure 130 of pump 100 thus supporting superstructure 130, although any structure or structures capable of supporting superstructure 130 may be used. Additionally, pump 100 could be constructed so there is no physical connection between the base and the superstructure, wherein the superstructure is independently supported. The motor, drive shaft and rotor could be suspended without a superstructure, wherein they are supported, directly or indirectly, to a structure independent of the pump base.

In the preferred embodiment, post clamps 133 secure posts 132 to superstructure 130. A preferred post clamp and preferred support posts are disclosed in a copending U.S. application Ser. No. 10/773,118 entitled "Support Post System For Molten Metal Pump," invented by Paul V. Cooper, and filed on Feb. 4, 2004, the disclosure of which is incorporated herein by reference. However, any system or device for securing posts to superstructure 130 may be used.

A motor 120, which can be any structure, system or device suitable for driving pump 100, but is preferably an electric or pneumatic motor, is positioned on superstructure 130 and is connected to an end of a drive shaft 122. A drive shaft 122 can be any structure suitable for rotating an impeller, and preferably comprises a motor shaft (not shown) coupled to a rotor shaft. The motor shaft has a first end and a second end, wherein the first end of the motor shaft connects to motor 120 and the second end of the motor shaft connects to the coupling. Rotor shaft 123 has a first end and a second end, wherein the first end is connected to the coupling and the second end is connected to rotor 110 or to an impeller according to the invention. A preferred coupling, rotor shaft and connection between the rotor shaft and rotor 110 are disclosed in a copending application entitled "Molten Metal Pump Components," invented by Paul V. Cooper and filed on Feb. 4, 2004, the disclosure of which is incorporated herein by reference.

The preferred rotor 110 is disclosed in a copending U.S. patent application Ser. No. 10/773,102 to Cooper, filed on Feb. 4, 2004 and entitled "Pump With Rotating Inlet", the disclosure of which is incorporated herein by reference. However, rotor 110 can be any rotor suitable for use in a molten metal pump and the term "rotor," as used in connection with this invention, means any device or rotor used in a molten metal pump chamber to displace molten metal.

Gas-transfer foot 300 and gas-transfer tube 350 combined forms a gas transfer assembly 360. Gas-transfer foot 300 is positioned next to (and may be attachable to) base 200 so that a gas outlet port 320 (shown in FIG. 1B) of the gas-transfer foot is in communication with a gas-release opening (not shown in FIG. 1A) in the base. Gas is fed into the gas source end of gas-transfer tube 350 which flows into the gas-transfer foot and then into the flow of molten metal within base 200.

Figure 1B:
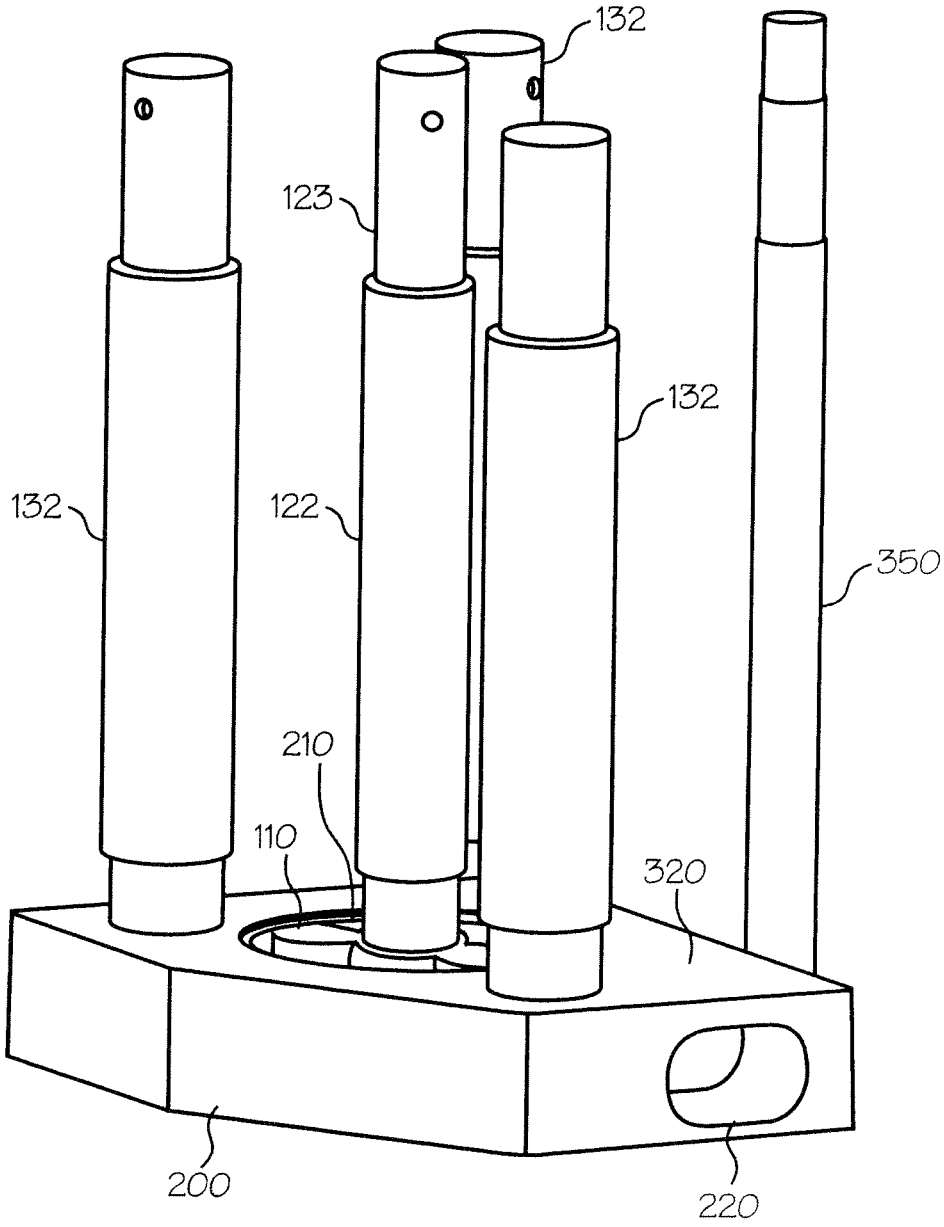
FIG. 1B depicts a three support post variation of the molten metal pump shown in FIG. 1A.

FIG. 1B depicts a variation of the molten metal pump shown in FIG. 1A. The molten metal pump in FIG. 1B has three support posts 132 rather than five. FIG. 1B also depicts the gas-releasing opening 320 of gas-transfer foot 300 when the gas-transfer foot 300 is positioned next to and/or attached to base 200.

Figure 1C:
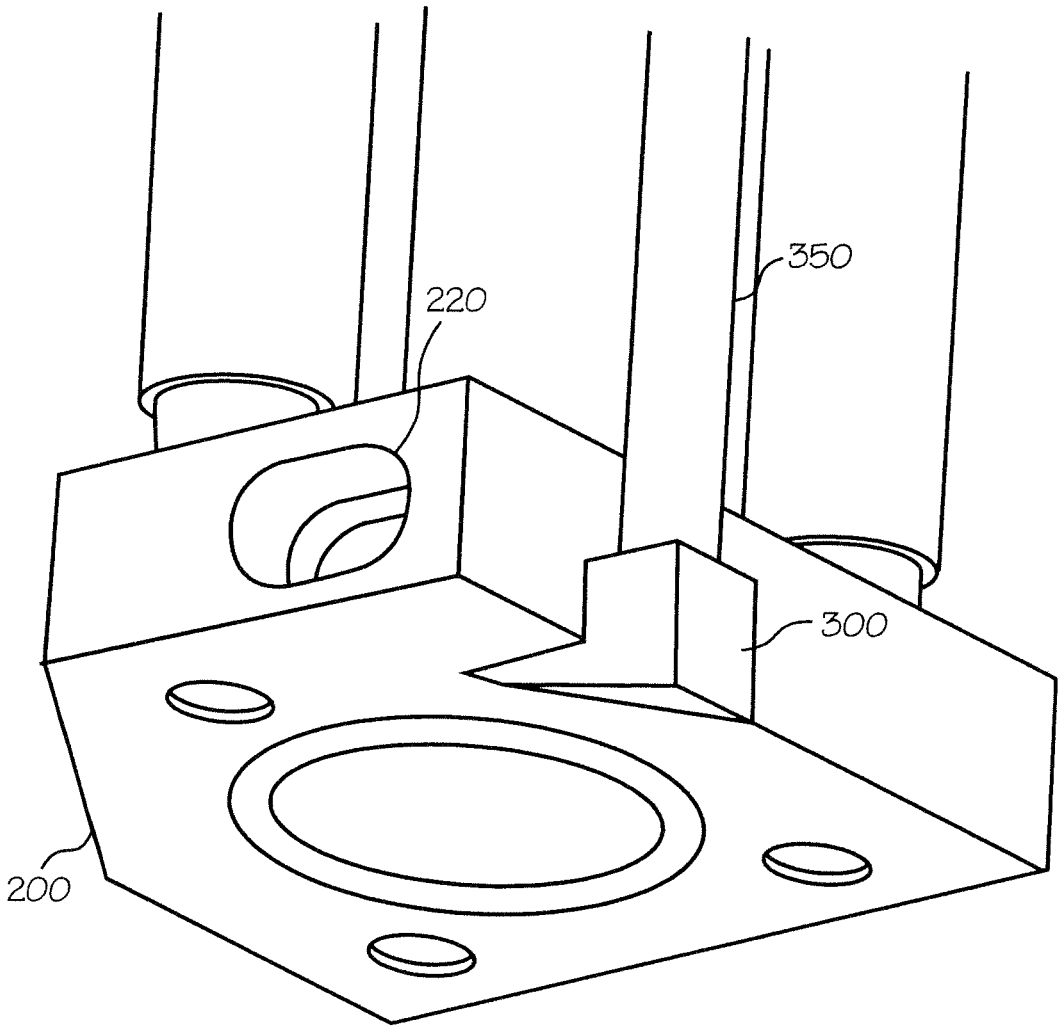
FIG. 1C depicts a bottom isometric view of a molten metal pump according to one embodiment of the invention.

As shown in FIG. 1C, gas-transfer foot 300 may be positioned next to molten metal pump 100 by inserting into a notch 214 constructed in base 200. In this way, the weight of the pump holds the gas-transfer foot in place. Methods for positioning, securing and/or attaching the gas-transfer foot next to the base need not be limited to the notch shown in FIG. 1C. All that is needed is a gas-transfer foot that may be positioned next to a molten metal pump base such that gas flowing through the foot may enter into a stream of molten metal flowing through the pump base and/or or a conduit extending from the pump base.

Figure 2A:
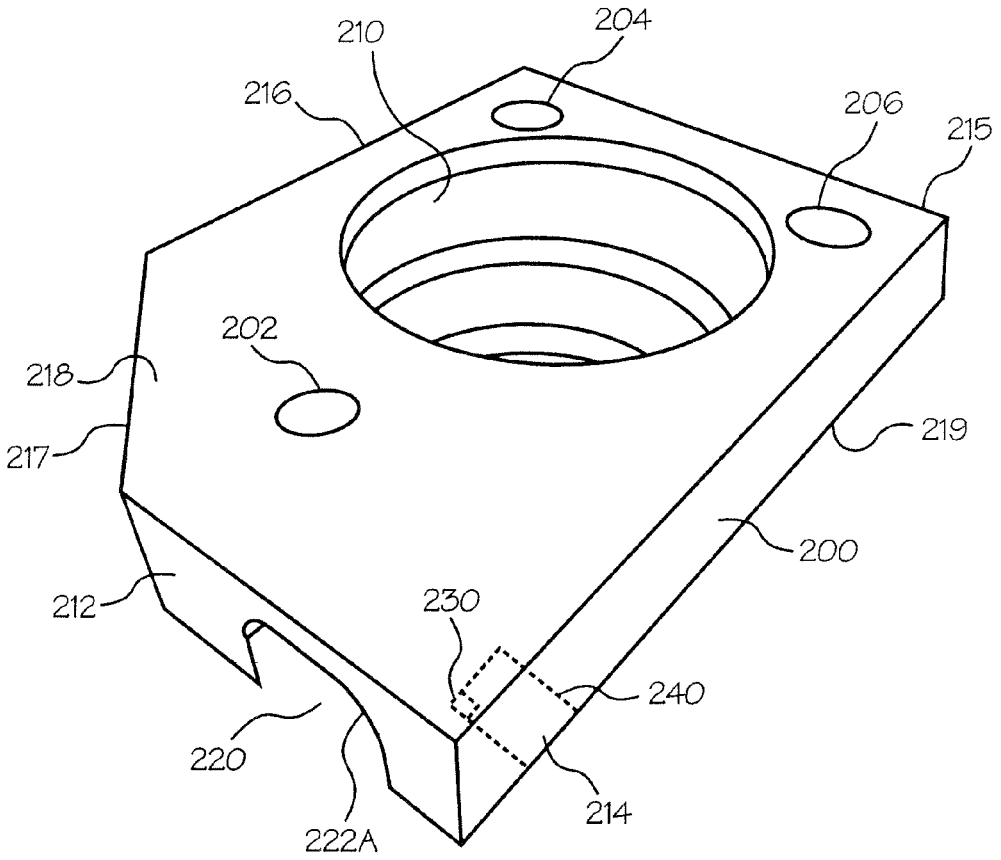
FIG. 2A depicts an isometric view of a base for a molten metal pump according to one embodiment of the invention.

FIG. 2A depicts an isometric view of a base for a molten metal pump according to one embodiment of the invention. Base 200 has a top surface 218, a bottom surface 219, a first side 212, a second side 214, a third side 215, a fourth side 216, and a fifth side 217. The base need not be constructed with five sides, but may be of any shape. Base 200 further includes one or more (and preferably three) cavities 202, 204 and 206 for receiving support posts 132. The cavities connect base 200 to support posts 132 such that support posts 132 can support superstructure 130, and can help to support the weight of base 200 when pump 100 is removed from a molten metal bath. Any structure suitable for this purpose may be used.

Base 200 also includes a discharge 220 that is in fluid communication with chamber 210. A notch 214 allows for the gas-transfer foot to be positioned next to the pump base. When in position the gas-release opening of the gas-transfer foot is in fluid communication with gas-release opening 230 such that gas may introduced into a stream of molten metal traveling through discharge 220.

Figure 2B:
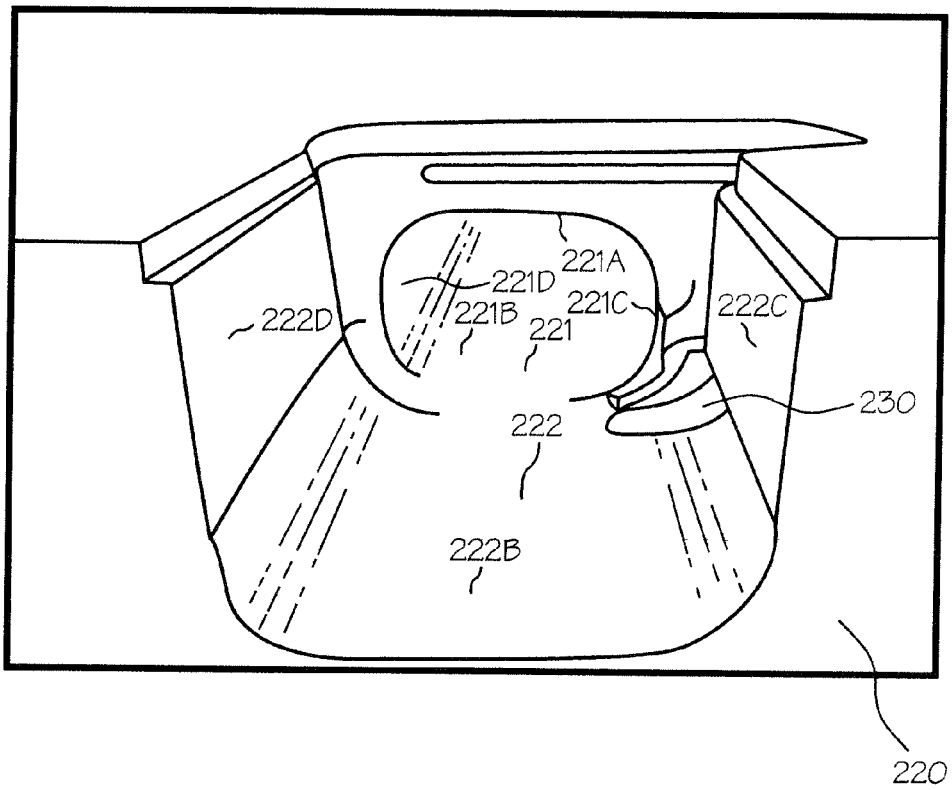
FIG. 2B depicts the discharge of a molten metal pump base according to one embodiment of the invention.

As shown in FIG. 2B, discharge 220 has at least two sections wherein at least one section (a first section) has a smaller cross-sectional area than at least one other section (a second section) downstream of the first section. Here, a first section 221 has a first cross-sectional area and a second section 222 is downstream of first section 32 and has a second cross-sectional area.

Section 221 is preferably about 1" in length, 3" in height and 4½" in width for a pump utilizing a 10" diameter rotor, and has a substantially flat top surface 221A, a substantially flat bottom surface 221B, a first radiused side surface 221C and a second radiused side surface 221D. Section 221 defines a passage through which molten metal may pass, and any shape or size passage suitable for efficiently conveying molten metal may be used.

Second section 222 is preferably 10" in length (although any suitable length may be utilized) and has a top surface 222A (shown in FIG. 2A), a bottom surface 222B, a first side surface 222C and second side surface 222D. Section 222 defines a passage through which molten metal passes and any shape or size passage suitable for efficiently conveying molten metal may be used. Section 222 preferably has a height of about 4" and width of about 5½" for a pump utilizing a rotor with a diameter of 10". Section 222 has a height of about 4" and width of about 6½" for a pump utilizing a rotor having a diameter of 16", and preferably has a cross-sectional area between about 110% and 350% larger than the cross-sectional area of section 221. However, all that is necessary for the proper functioning of the invention is that the cross-sectional area of section 222 be sufficiently larger than the area of section 221 to reduce the amount of pressure required for gas to be released into the molten metal stream as compared to the pressure required to release gas into a metal-transfer conduit that has substantially the same cross-sectional area throughout.

Alternatively, discharge 220 or any metal-transfer conduit in accordance with the invention could have multiple cross-sectional areas, as long as there is a transition from a first section with a first cross-sectional area to a second section with a second cross-sectional area, wherein the second section is downstream of the first section and the second cross-sectional area is greater than the first cross-sectional area. It is preferred that there be an abrupt transition from the first section having a first cross-sectional area to a second section having a second, larger cross-sectional area, however, the transition may be somewhat gradual, taking place over a length of up to 6" or more.

Preferably, a gas-release opening 230 is formed in second section 222 through bottom surface 219 of base 200. However, gas-release opening 230 may also be formed in a top or side section of base 200. Gas-release opening 230 is any size suitable for releasing gas from an opening in gas-transfer foot 300 into discharge 220. It is preferred that gas-release opening 230 be formed outside of the higher-pressure flow of the molten metal stream (such as in section 222), but it can be positioned anywhere suitable for releasing gas into discharge 220. For example, as shown in FIG. 2B gas-release opening 230 may be formed in second section 222 near (preferably within 3") first section 221. However, all that is necessary for the proper functioning of the invention is that there be (1) a first section for transferring a molten metal stream having a first cross-sectional area and a second section downstream of the first section, wherein the second section has a second cross-sectional area larger than the first section, and (2) a gas-release opening in the first section and/or the second section (preferably in or near the bottom surface of either section), whereby the respective sections are configured and the gas-release openings is positioned so that less pressure is required to release gas into the molten metal than would be required in known metal-transfer conduits that have substantially the same cross-sectional area throughout. Thus, in addition to a gas-release opening being formed in the first section or the second section, a gas-release opening could be formed in the first section and another gas-release opening could be formed in the second section, and gas could be released into each section, or into one section or the other.

Figure 2C:
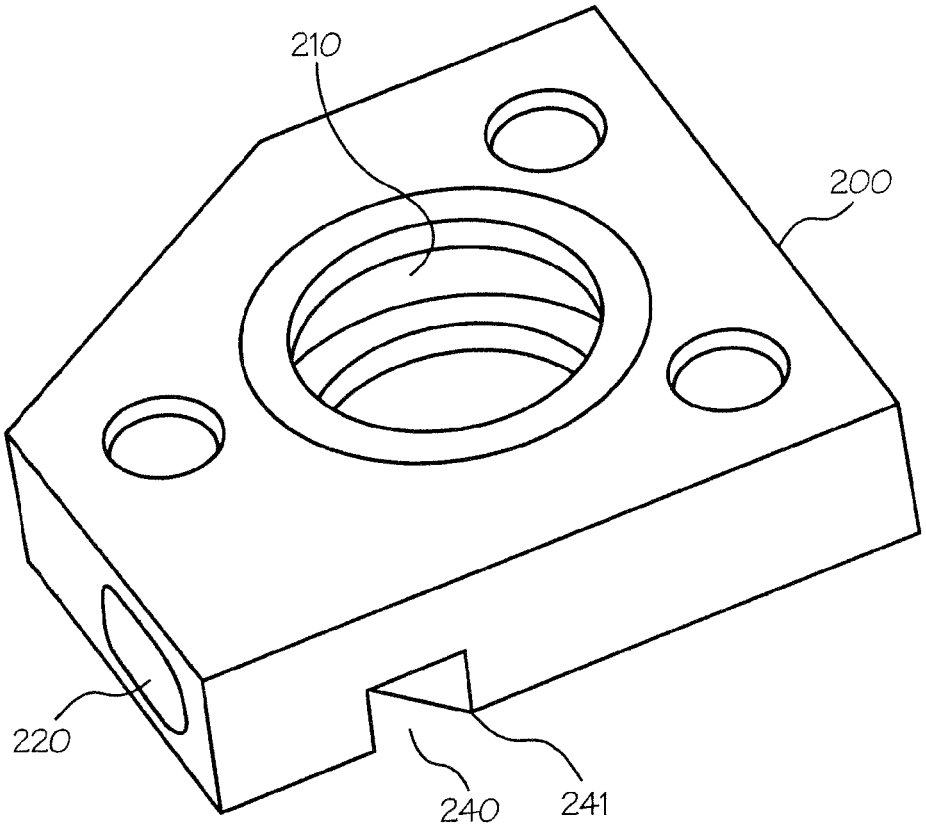
FIG. 2C depicts a top isometric view of a pump base with a gas-transfer foot notch according to one embodiment of the invention.
Figure 2D:
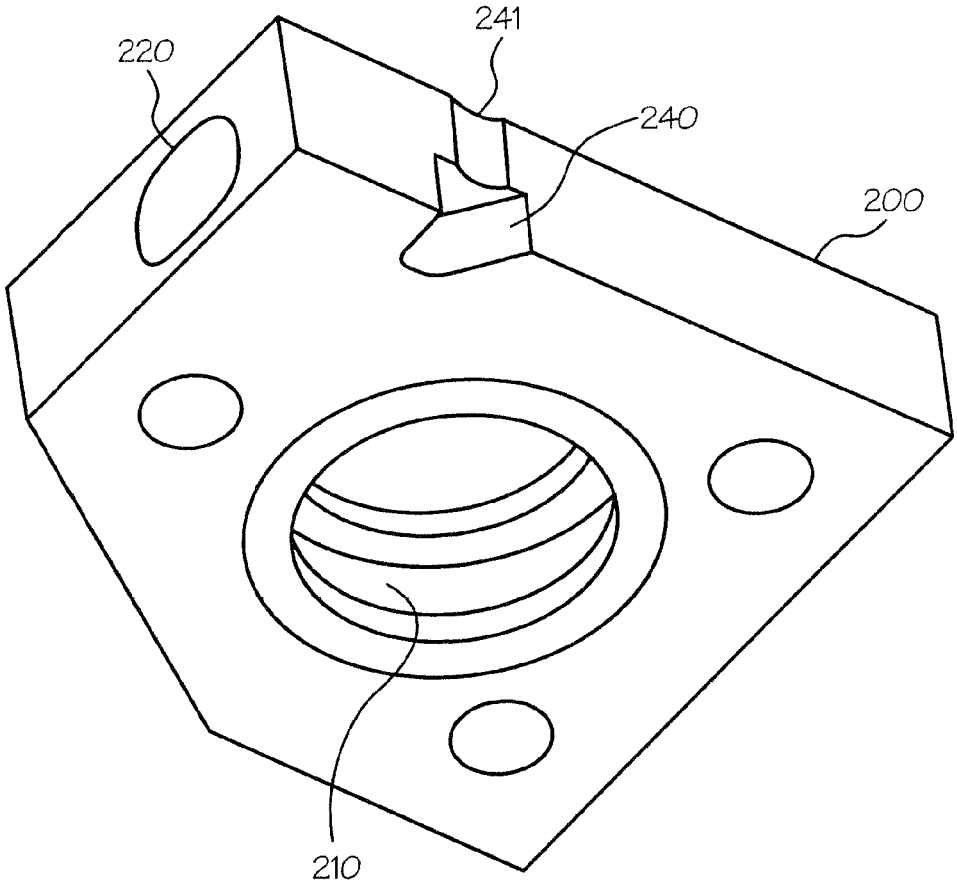
FIG. 2D depicts a bottom isometric view of a pump base with a gas-transfer foot notch according to one embodiment of the invention.

FIGS. 2C and 2D show gas-transfer foot notch 240 for attachment of a gas-transfer foot. The notch is shaped so as to accept the gas-transfer foot 300 (described below) and is preferably positioned in the bottom surface of base 200 so that the weight of the base secures gas-transfer foot 300 when it is inserted into notch 240. Though not required, the gas-transfer foot may be cemented in place or otherwise secured to the base in any suitable manner. As shown, notch 240 includes one angled side to accept a gas-transfer foot with an angled side. However, any shape notch is suitable as long as it is configured to properly position the gas-transfer foot so that gas released from the gas-release opening of the gas-transfers enters into the molten metal stream when the gas-transfer foot is inserted into the notch. In addition, pump base 200 may also include a tube notch 241 so that gas-transfer tube 350 may be positioned closer to pump base 200 and be held more firmly in place.

Figure 2E:
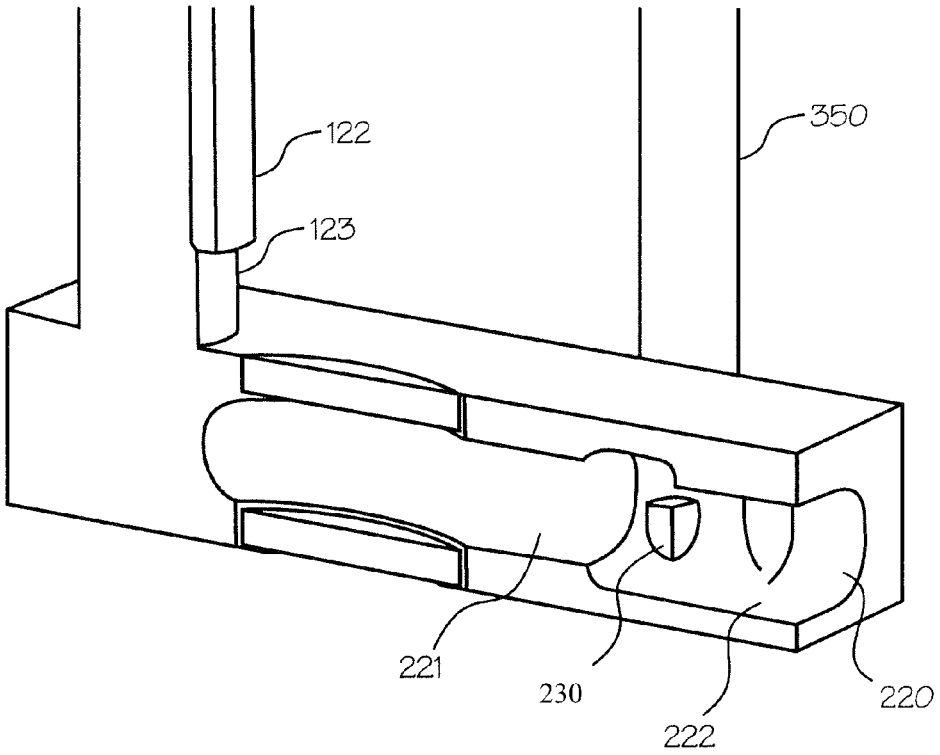
FIG. 2E depicts a vertical cross-sectional view of a pump base and attached gas-transfer assembly according to one embodiment of the invention.
Figure 2F:
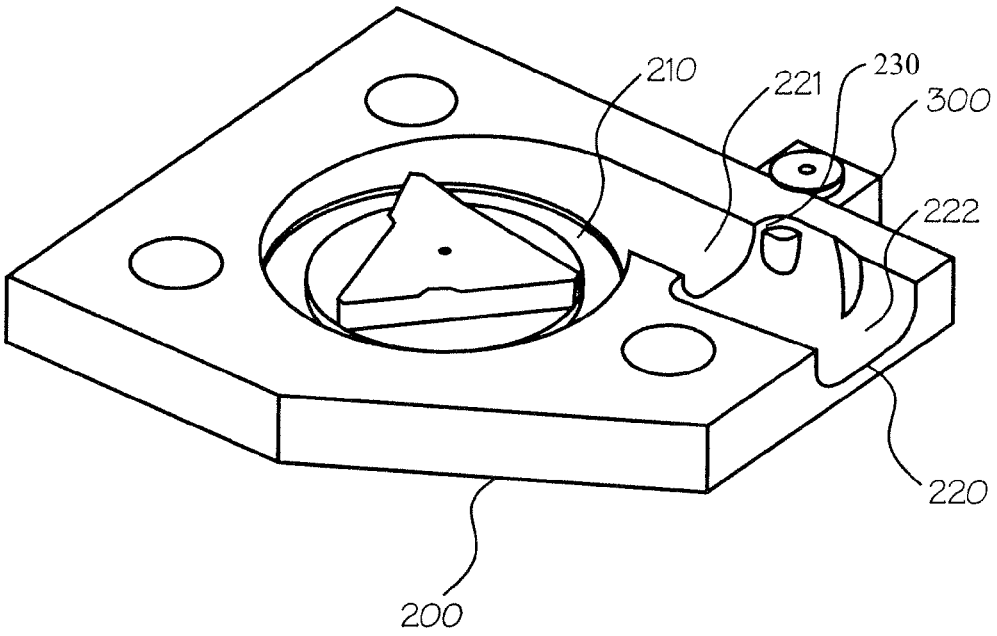
FIG. 2F depicts a horizontal cross-sectional view of a pump base and attached gas-transfer foot according to one embodiment of the invention.
Figure 2G:
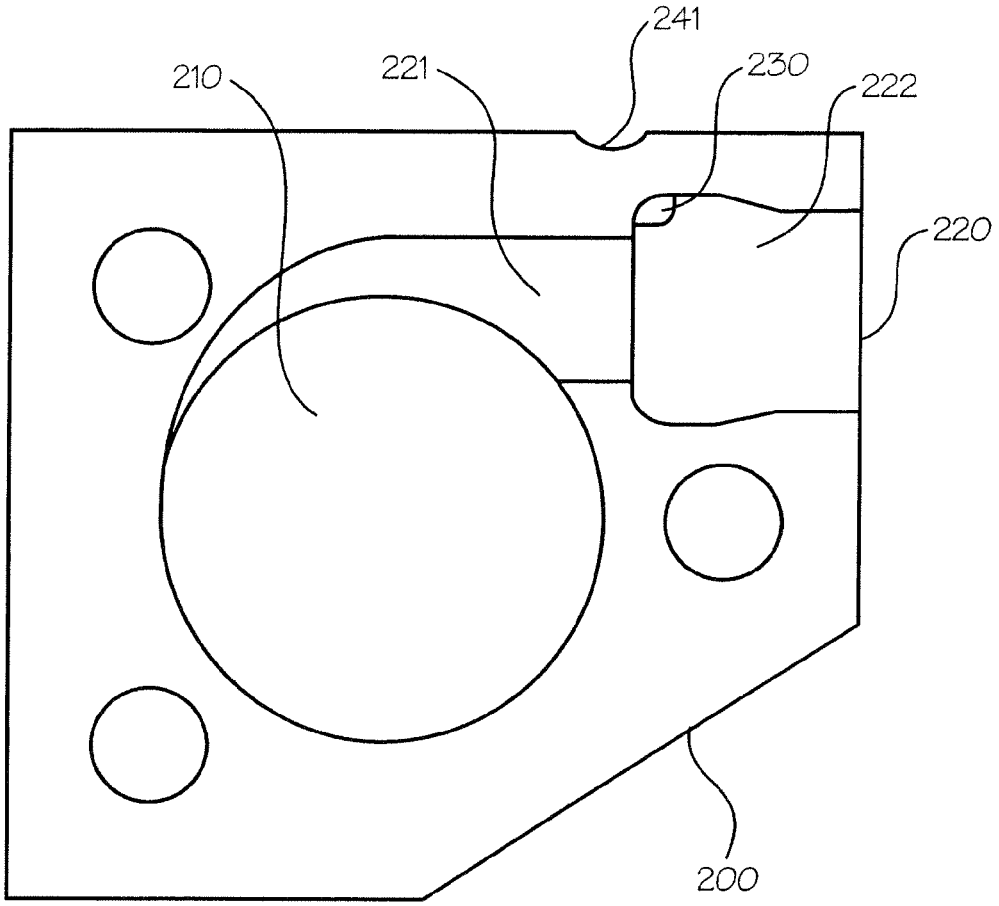
FIG. 2G depicts a top-down horizontal cross-sectional view of a pump base according to one embodiment of the invention.
Figure 2H:
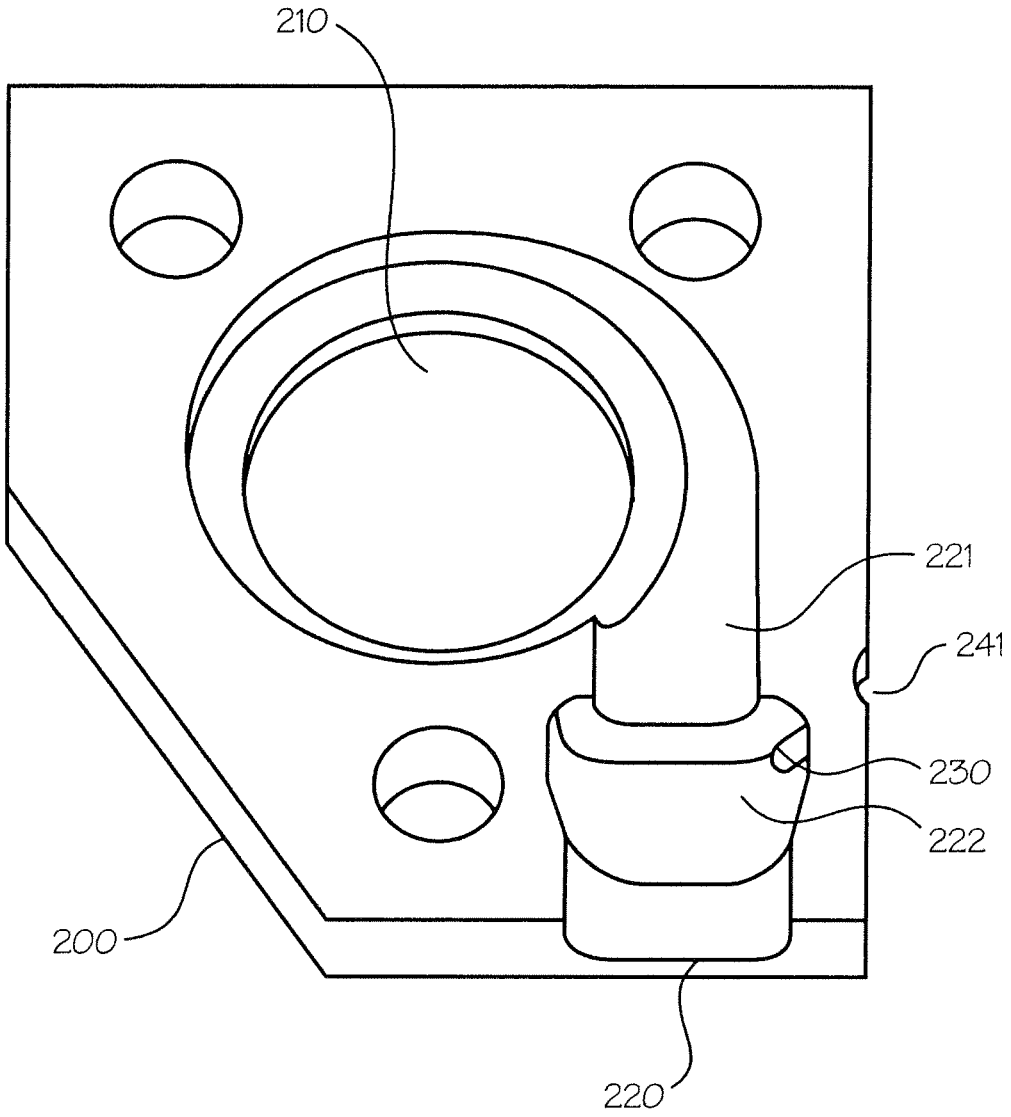
FIG. 2H depicts an isometric horizontal cross-sectional view of a pump base according to one embodiment of the invention.

FIGS. 2E-F show cross-sectional views of a pump base with and without an attached gas-transfer foot. FIG. 2E depicts a vertical cross-sectional view of a pump base and attached gas-transfer assembly. FIG. 2F depicts a horizontal cross-sectional view of a pump base and attached gas-transfer foot. FIG. 2G depicts a top-down horizontal cross-sectional view of a pump base. FIG. 2H depicts an isometric horizontal cross-sectional view of a pump base.

FIG. 3 depicts a gas-transfer assembly 360 according to the invention. The gas-transfer assembly 360 includes gas-transfer foot 300 and gas-transfer tube 350. Gas-transfer foot 300 includes a gas outlet port 320 which is in fluid communication with gas-release opening 230 (see FIGS. 2A-H) when the foot is positioned next to and/or attached to the base. The gas outlet port may be any size that allows for the release of gas into a stream of molten metal, and is preferably at least ½ inch in diameter.

Gas-transfer tube 350 is preferably a cylindrical, graphite tube having a first end 351 (connectable to a gas source) and a second end 352 (for connecting to the gas-transfer foot) and a passage extending therethrough. Preferably second end 352 is threaded so as to provide a secure fit into the threaded hole of gas inlet port 310. However, any structure capable of transferring gas from a gas source (not shown) to gas-transfer foot according to the invention may be used.

Figure 3A:
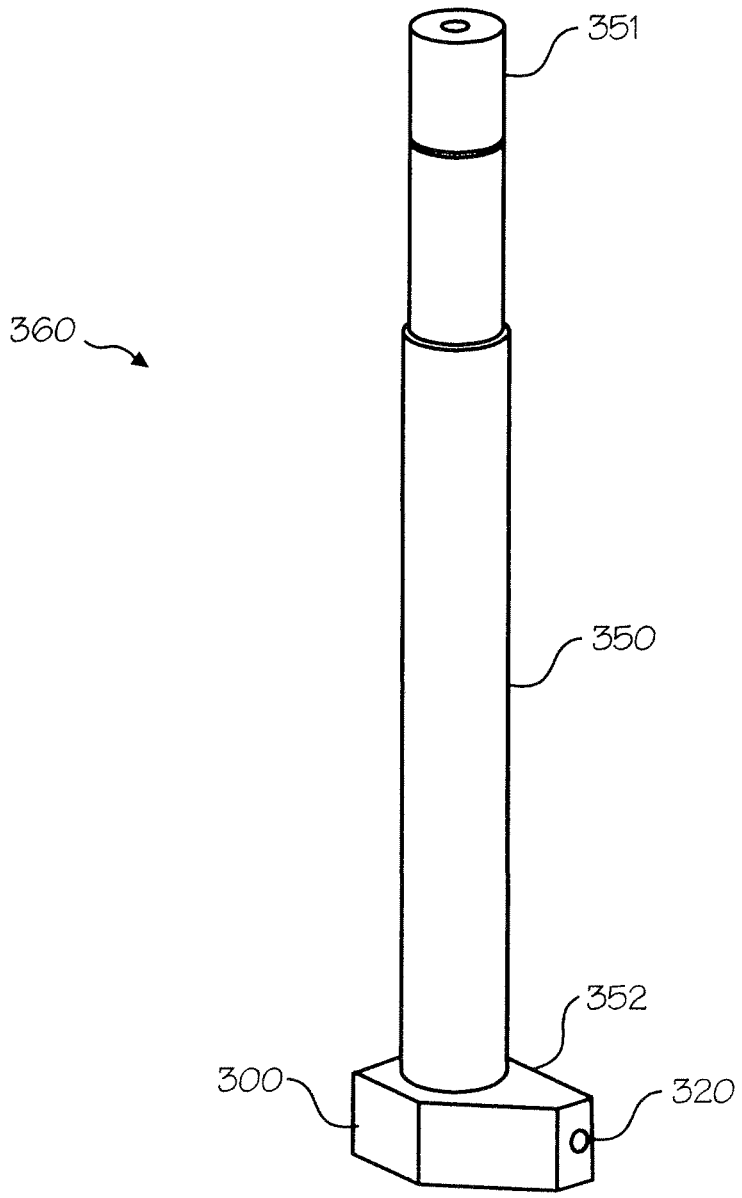
FIG. 3A depicts a gas-transfer assembly according to one embodiment of the invention.
Figure 3B:
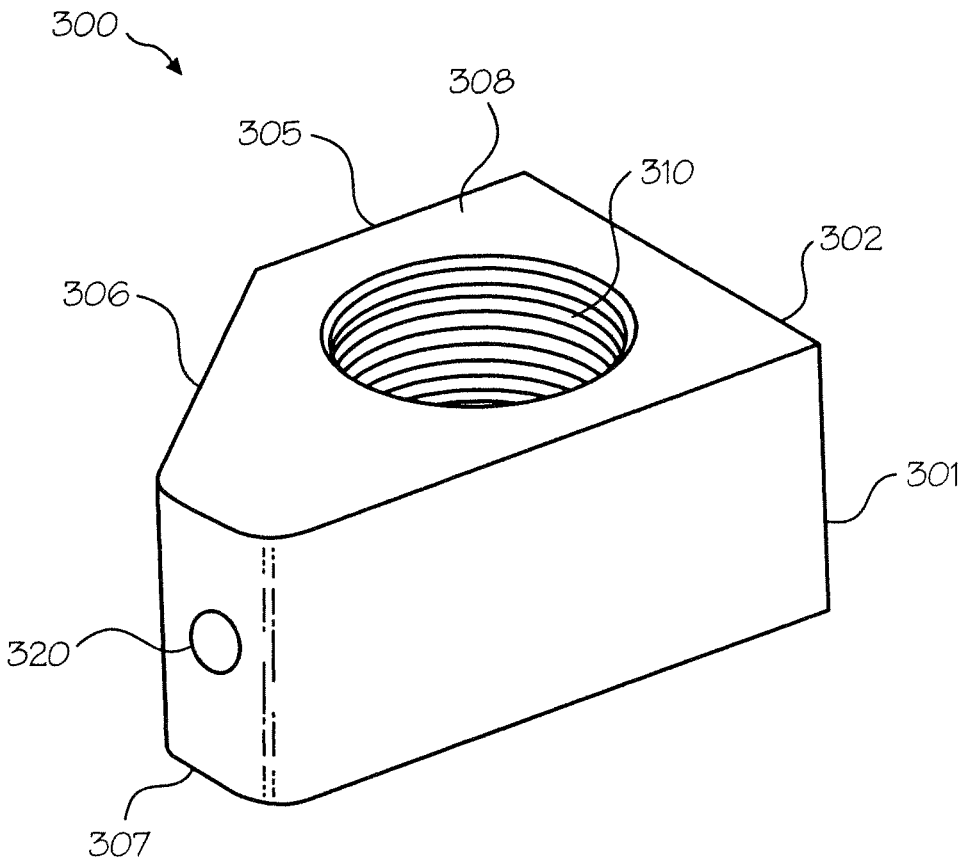
FIG. 3B depicts an isometric view of a gas-transfer foot according to one embodiment of the invention.
Figure 3C:
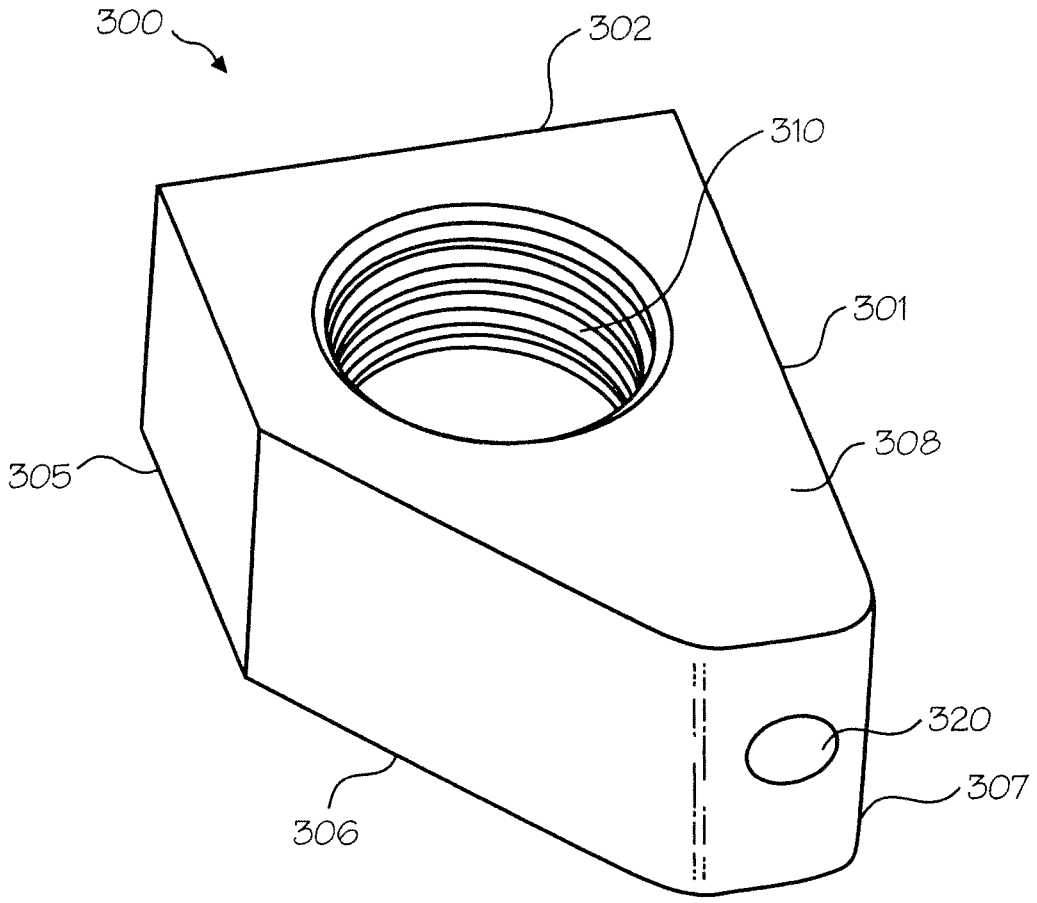
FIG. 3C depicts another isometric view of a gas-transfer foot according to one embodiment of the invention.

As depicted in FIGS. 3B and 3C, gas-transfer foot 300 has a top surface 308, a bottom surface 310, and sides 301, 302, 305, 306 and 307. As shown, side 306 is angled so as to fit into notch 240 as described above. However, the gas-transfer foot need not be shaped as depicted (it could have more or fewer sides and be of any suitable shape), but preferably is shaped so that it is received into a notch in the base of a molten metal pump or metal-transfer conduit to be positioned such that gas released from the foot passes into the molten metal stream in either the base or metal-transfer conduit. Gas-transfer foot 300 also includes gas inlet port 310 through which gas enters the foot from gas-transfer tube 350. In this embodiment, gas inlet port 310 is shown to be threaded to accept a threaded end of gas-transfer tube 350. However, any method for attaching the gas-transfer tube to the gas-transfer foot may be used so long as gas is able to flow from the tube into the foot.

Figure 3D:
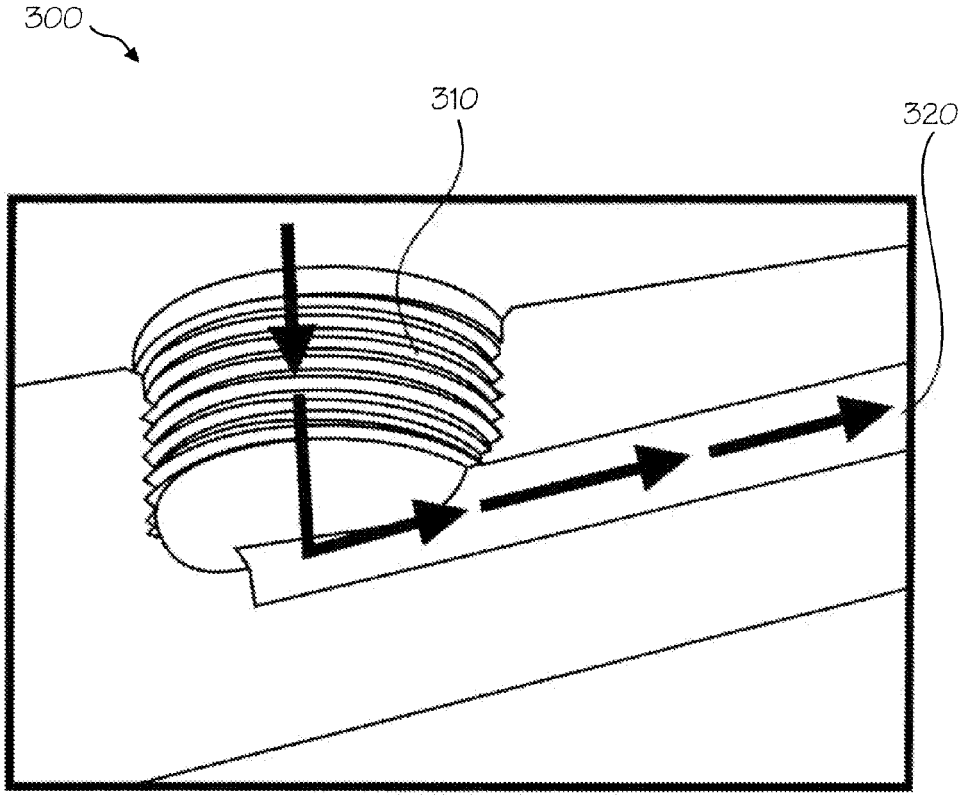
FIG. 3D depicts a vertical cross-sectional view of a gas-transfer foot according to one embodiment of the invention.

As shown in FIG. 3D, gas inlet port 310 is in fluid communication with gas outlet port 320. Gas inlet port 310 may be of any size that allows for connection with gas-transfer tube 350, and is preferably at least a ½ inch diameter opening.

Figure 4:
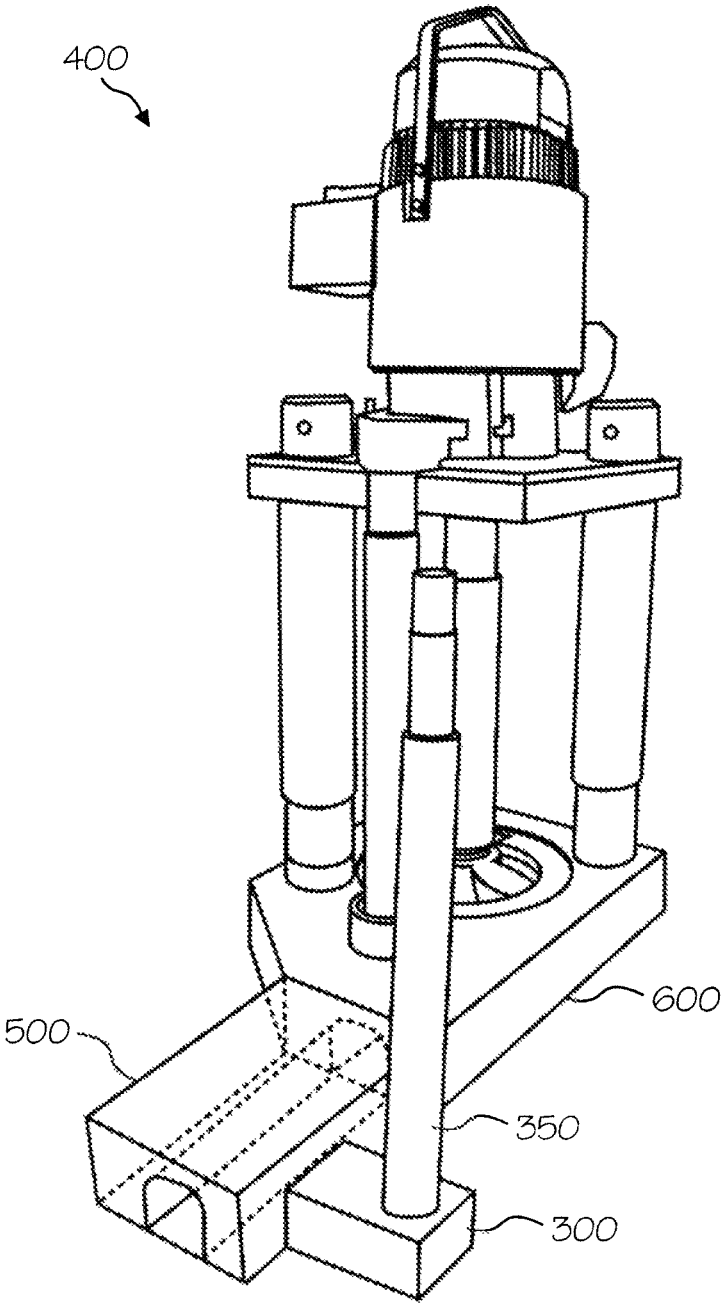
FIG. 4 is another embodiment of a molten metal pump according to the invention.

FIG. 4 depicts a molten metal pump according to a second embodiment of the invention. In this embodiment pump 400 includes a metal-transfer conduit 500 and a base 600. The remaining components are the same as described above with reference to pump 100. In this embodiment, metal-transfer conduit 500 is in communication with the discharge of base 600 so that the stream of molten metal flows through the conduit. A gas-transfer foot is insertable into the metal-transfer conduit so that gas is released into the bottom of the stream of molten metal within the conduit.

Base 600 is similar to base 400 except that base 600 need not have a gas-release opening or a gas-transfer foot notch. However, a base with a gas-release opening and notch in which a gas-transfer foot is inserted may be used in conjunction with the metal-transfer conduit so that gas may be released into the steam of molten metal at both the base and the conduit.

Figure 5A:
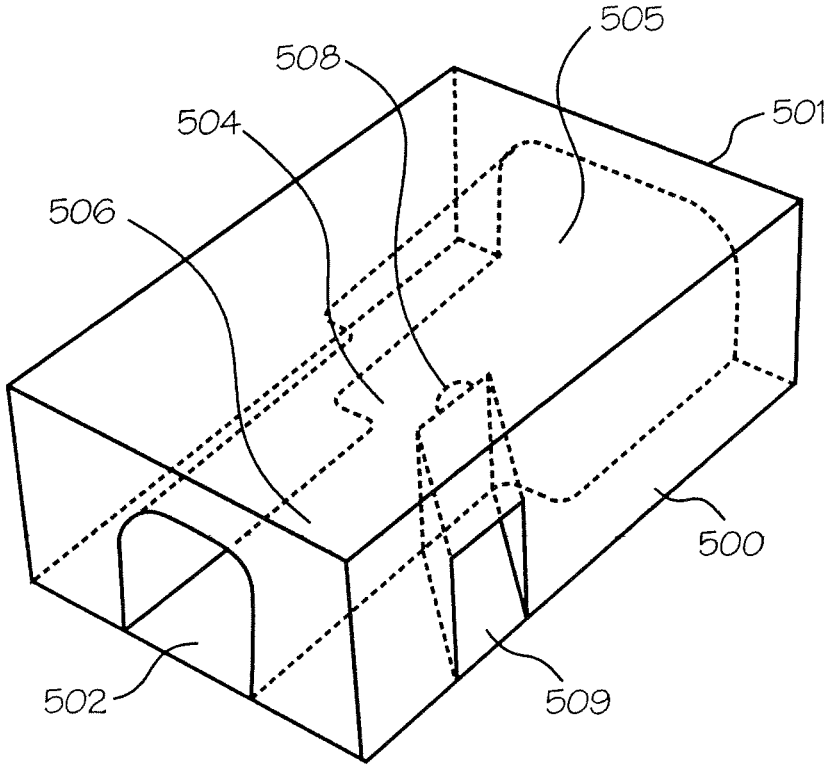
FIG. 5A is an embodiment of a metal-transfer conduit according to the present invention.

FIG. 5A depicts a metal-transfer conduit according to the invention. Metal-transfer conduit 500 includes inlet port 501 and outlet 502. The inlet port and outlet port are in fluid communication via conduit path 504. Conduit path 504 has at least two sections wherein at least one section (a first section) has a smaller cross-sectional area than at least one other section (a second section) downstream of the first section. Here, a first section 506 has a first cross-sectional area and a second section 505 is downstream of first section 506 and has a second cross-sectional area.

Section 506 is preferably about 1" in length, 3" in height and 4½" in width for a pump utilizing a 10" diameter rotor, and has a substantially flat top surface, a substantially flat bottom surface, a first radiused side surface and a second radiused side surface. Section 506 defines a passage through which molten metal may pass, and any shape or size passage suitable for efficiently conveying molten metal may be used.

Second section 505 is preferably 10" in length (although any suitable length may be utilized) and has a top surface, a bottom surface, a first side surface and second side surface. Section 505 defines a passage through which molten metal passes and any shape or size passage suitable for efficiently conveying molten metal may be used. Section 505 preferably has a height of about 4" and width of about 5½" for a pump utilizing a rotor with a diameter of 10". Section 506 has a height of about 4" and width of about 6½" for a pump utilizing a rotor having a diameter of 16", and preferably has a cross-sectional area between about 110% and 350% larger than the cross-sectional area of section 506. However, all that is necessary for the proper functioning of the invention is that the cross-sectional area of section 505 be sufficiently larger than the area of section 506 to reduce the amount of pressure required for gas to be released into the molten metal stream as compared to the pressure required to release gas into a metal-transfer conduit that has substantially the same cross-sectional area throughout.

Alternatively, conduit path 504 could have multiple cross-sectional areas, as long as there is a transition from a first section with a first cross-sectional area to a second section with a second cross-sectional area, wherein the second section is downstream of the first section and the second cross-sectional area is greater than the first cross-sectional area. It is preferred that there be an abrupt transition from the first section having a first cross-sectional area to a second section having a second, larger cross-sectional area, however, the transition may be somewhat gradual, taking place over a length of up to 6" or more.

Figure 5B:
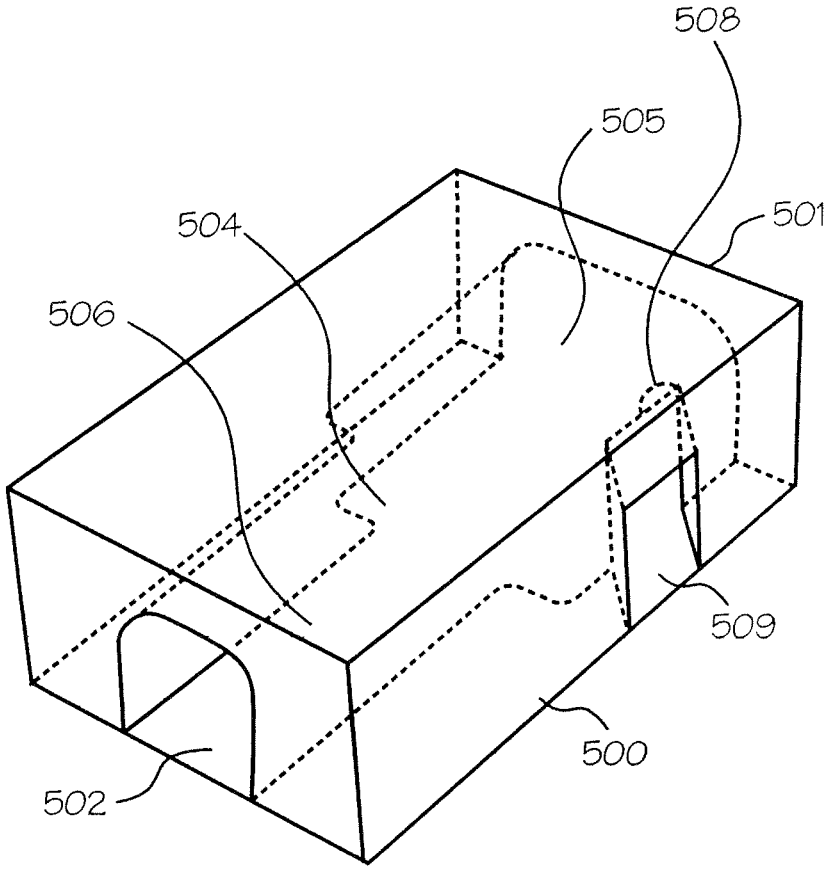
FIG. 5B is another embodiment of a metal-transfer conduit according to the present invention.
Figure 6A:
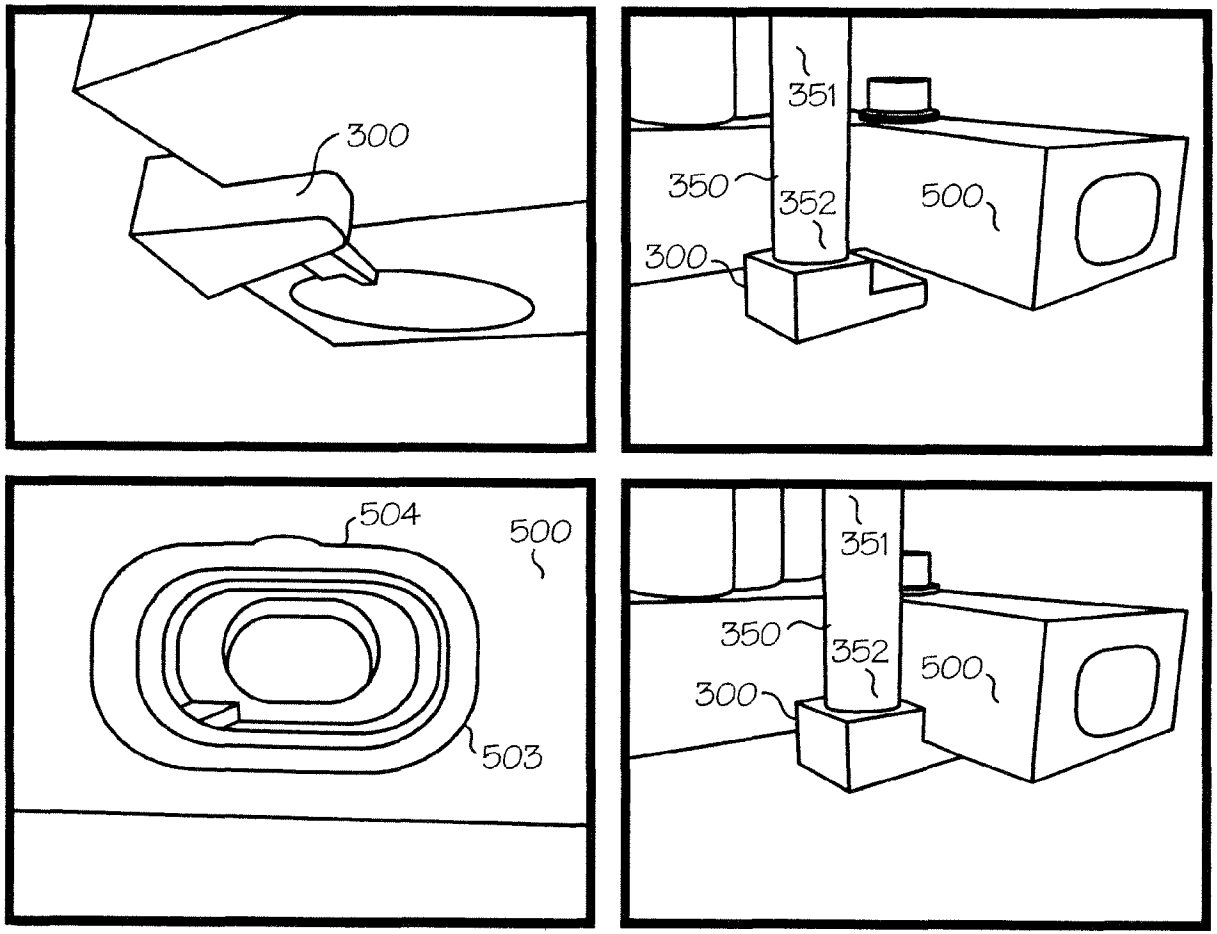
FIGS. 6A-D show photographs of other views of metal-transfer conduits and gas-transfer assemblies according to various aspects of the invention
Figure 6B:
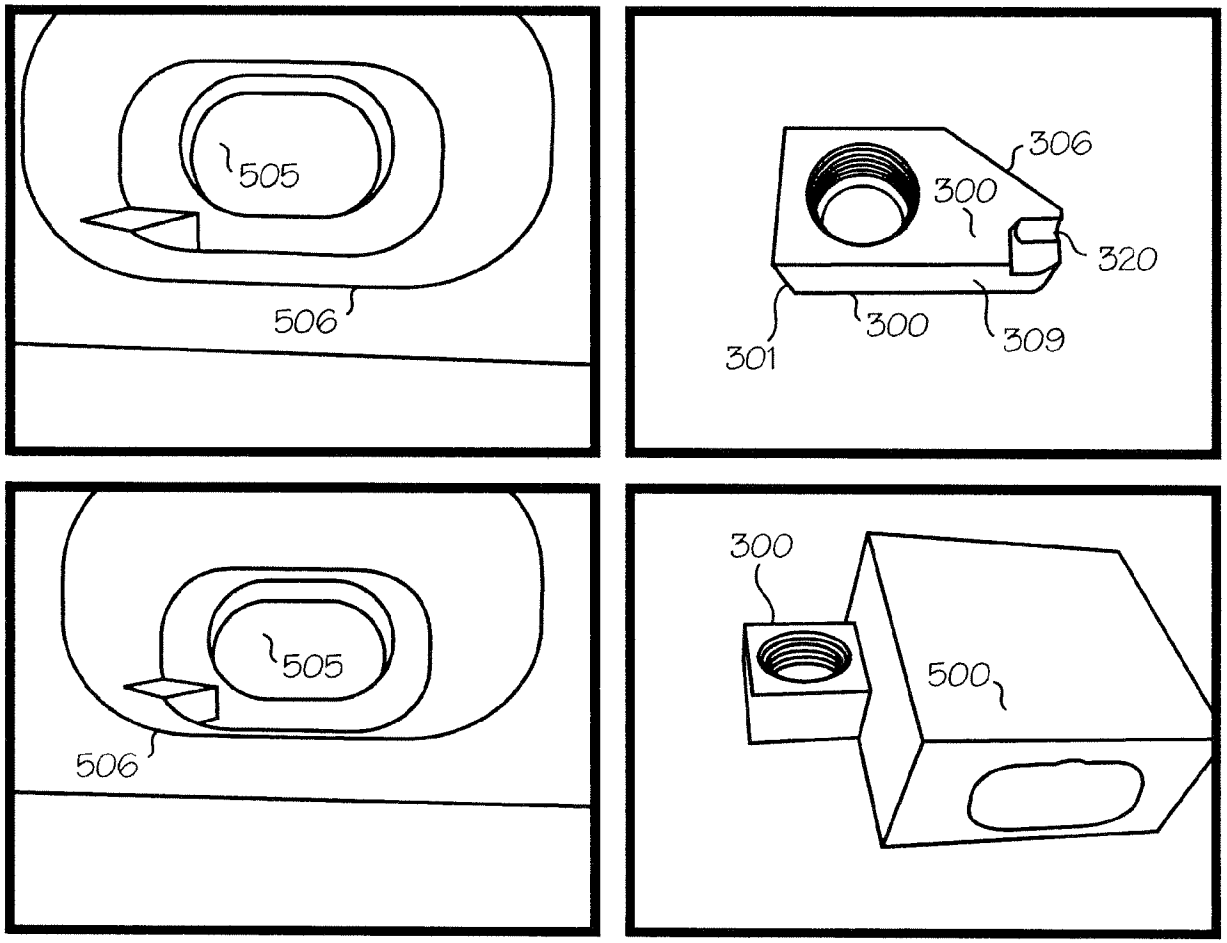
Figure 6C:
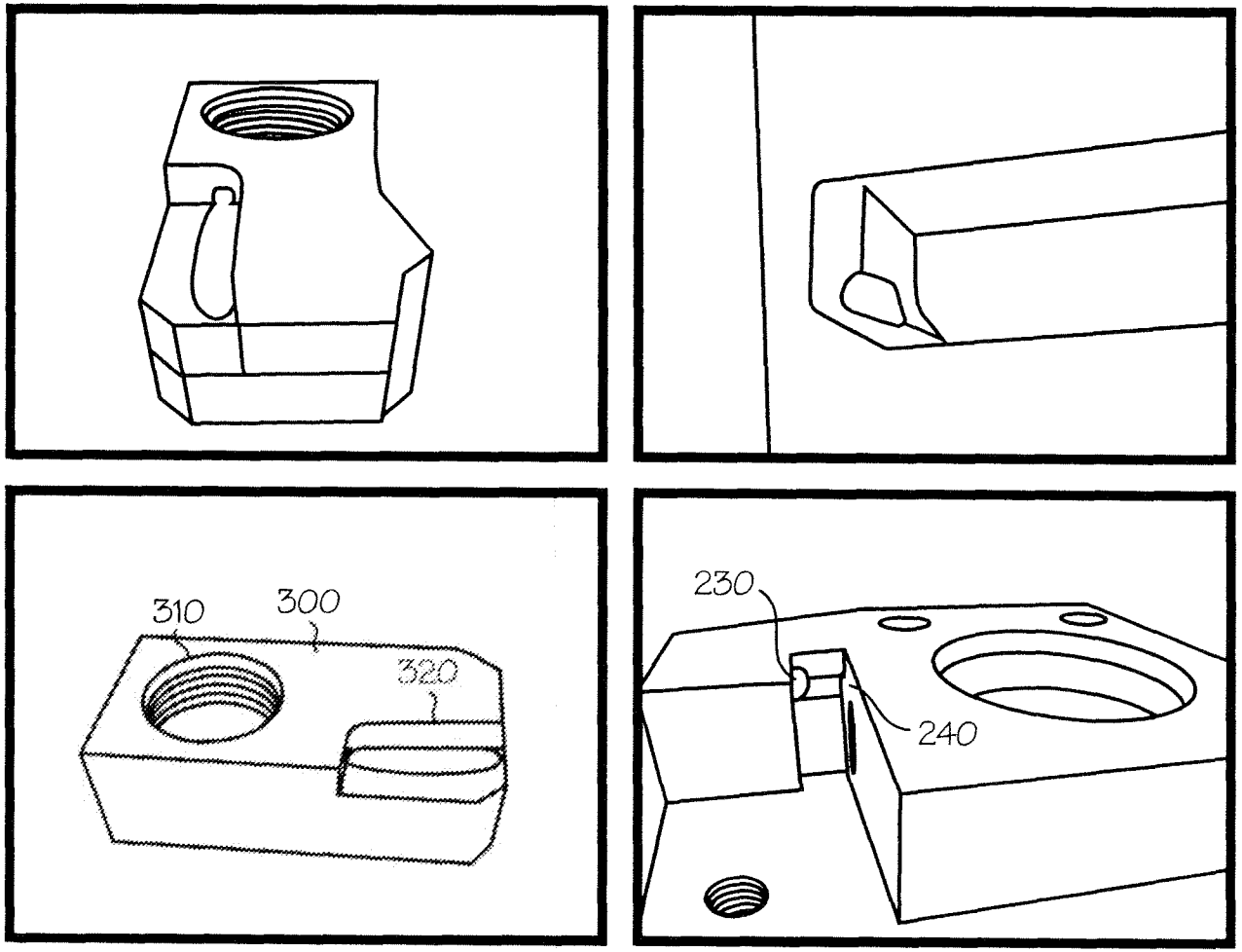
Figure 6D:
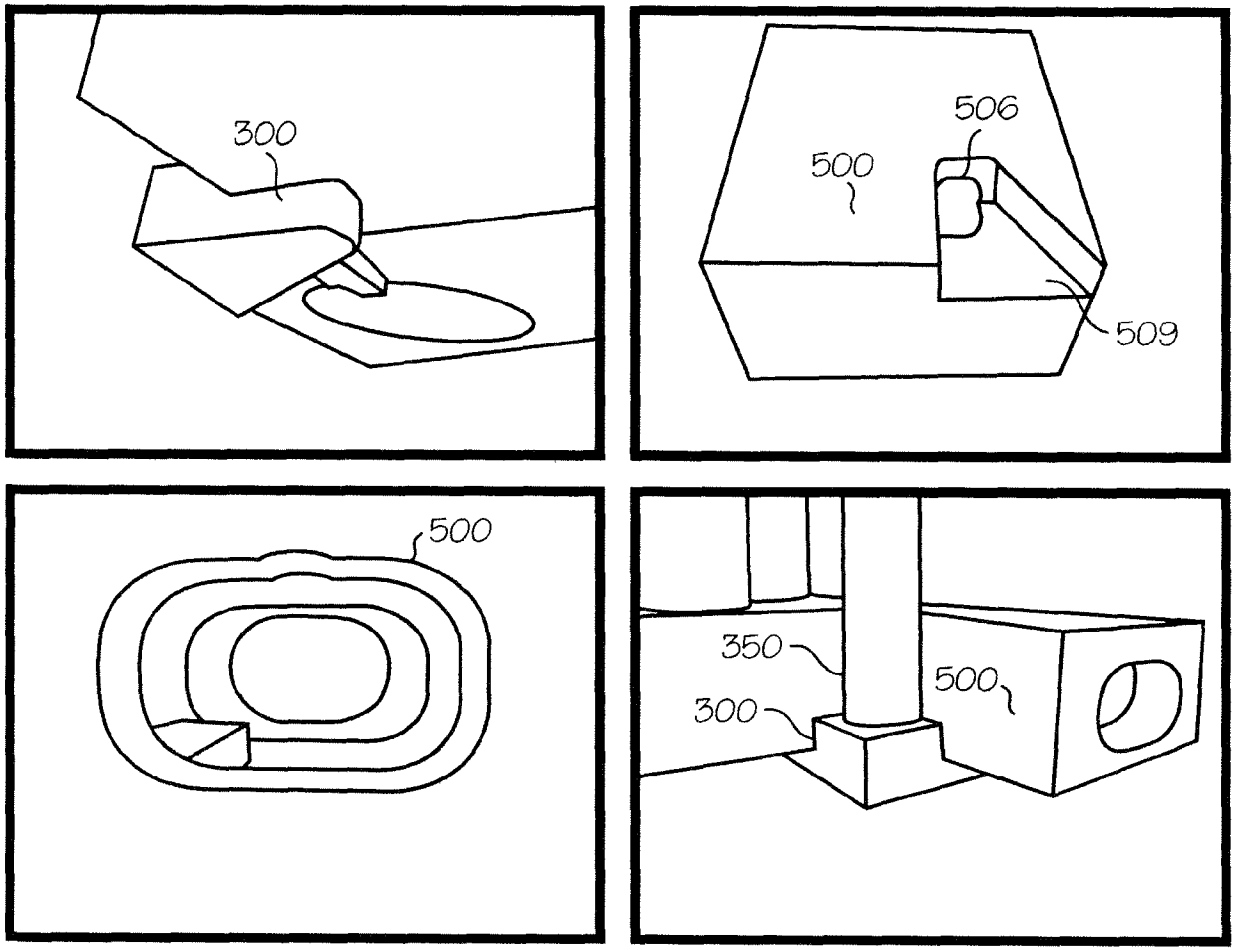

A gas-release opening 508 is formed in second section 505 through the bottom surface metal-transfer conduit 500. Gas-release opening 508 is any size suitable for releasing gas from an opening in gas-transfer foot 300 into conduit path 504. It is preferred that gas-release opening 508 be formed outside of the high-pressure flow of the molten metal stream (such as in section 506), but it can be positioned anywhere suitable for releasing gas into conduit path 504. For example, as shown in FIG. 5B gas-release opening 508 may be formed in first section 506 near (preferably within 3") second section 505. All that is necessary for the proper functioning of the invention is that there be (1) a first section of a metal-transfer conduit having a first cross-sectional area and a second section of the metal-transfer conduit downstream of the first section, wherein the second section has a second cross-sectional area larger than the first section, and (2) a gas-release opening in the bottom surface of the first section and/or the second section, whereby the respective sections are configured and the gas-release openings is positioned so that less pressure is required to release gas into the molten metal than would be required in known metal-transfer conduits that have substantially the same cross-sectional area throughout. Thus, in addition to a gas-release opening being formed in the first section or the second section, a gas-release opening could be formed in the first section and another gas-release opening could be formed in the second section, and gas could be released simultaneously into each section, or into one section or the other.

Metal-transfer conduit 500 also includes a gas-transfer foot notch 509 for attachment of a gas-transfer foot. The notch is shaped so as to accept the gas-transfer foot. Preferably, notch 509 is positioned in the bottom surface of metal-transfer conduit 500 so that the weight of the conduit secures the gas-transfer in position. Though not required, the foot may be cemented in place or otherwise be maintained in place by any suitable means As with the notch in the pump base, notch 509 may includes one angled side to accept a gas-transfer foot with an angled side. However, any shape notch is suitable as long as the gas-transfer foot is secure when inserted into the notch. In addition, notch 509 should be constructed so that the gas outlet port of the gas-transfer foot is in communication with the gas-release opening when the gas-transfer foot is inserted into the notch.

FIGS. 6A-D show photographs of other views of metal-transfer conduits and gas-transfer assemblies according to various aspects of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A molten metal pump including:

(a) a motor;

(b) a rotor;

(c) a shaft connecting the motor to the rotor;

(d) a base comprising:

a pump chamber; and a discharge in communication with the pump chamber;

(e) a metal-transfer conduit downstream of the discharge, the metal-transfer conduit in communication with the discharge such that at least some of the molten metal moving through the discharge also moves through the metal-transfer conduit;

the metal-transfer conduit having an internal channel including a first section having a first cross-sectional area and a second section having a second cross-sectional area, the second section being downstream of the first section and the second cross-sectional area being greater than the first cross-sectional area; and a gas-release opening on the bottom surface of the channel in communication with one or more of the group consisting of the first section and the second section; and (f) a gas-transfer foot comprising:

a gas inlet port through which gas passes into the gas-transfer foot; and a gas outlet port in communication with the gas-release opening so that gas can be transferred from the gas outlet port through the gas-release opening into the conduit channel.

2. The pump of claim 1, wherein a notch is formed in the metal-transfer conduit such that when the gas-transfer foot is inserted into the notch it is in communication with the gas-release opening.

3. The pump of claim 1 wherein the gas-release opening is in communication with the first section.

4. The pump of claim 1 wherein the gas-release opening is in communication with the second section.

5. The pump of claim 1 wherein the internal channel has sections in addition to the first section and second section.

6. The pump of claim 5 wherein the gas-release opening is in communication with the second section.

7. The pump of claim 1 wherein the gas-release opening is in communication with both the first section and the second section.

8. The pump of claim 1 that further includes a gas-transfer conduit having a first end connectable to a gas source and a second end connectable to the gas-inlet port of the gas-release foot.

9. The pump of claim 1 wherein the pump base and the gas-transfer foot are comprised of graphite.

10. The pump of claim 1 wherein the notch has a first end at a side of the base and a second end opposite the first end, the first end having a width greater than the width of the second end.

11. The pump of claim 10 wherein the gas release opening is formed at the second end.

12. The pump of claim 1 wherein the gas-transfer foot is cemented to the base after being received in the notch.

13. The molten metal pump of claim 4 wherein the gas-release opening is positioned within 3" of the first section.

14. The molten metal pump of claim 4 wherein the gas-release opening is positioned within 12" of the first section.

15. The molten metal pump of claim 4 wherein the gas-release opening is positioned in a bottom wall of the second section.

16. The molten metal pump of claim 3 wherein the gas-release opening is formed in a bottom wall of the first section.

17. The molten metal pump of claim 1 wherein the second cross-sectional area is between 110% and 350% larger than the first cross-sectional area.

* * * * *